US008719109B1

(12) United States Patent
Elicin et al.

(10) Patent No.: US 8,719,109 B1
(45) Date of Patent: May 6, 2014

(54) FACILITATING TRANSACTIONS INVOLVING ITEMS BY NOTIFYING SELECTED USERS OF DEMAND FOR ITEMS

(75) Inventors: Mehmet A. Elicin, Seattle, WA (US); Pierre Galin, Seattle, WA (US); Chien-Chung Huang, Hanover, NH (US); Vijay Kumar, Seattle, WA (US); Jonathan D. Phillips, Seattle, WA (US); Brian J. Saltzman, Seattle, WA (US)

(73) Assignee: Amazon Technologies, Inc., Reno, NV (US)

( * ) Notice: Subject to any disclaimer, the term of this patent is extended or adjusted under 35 U.S.C. 154(b) by 2153 days.

(21) Appl. No.: 11/693,501

(22) Filed: Mar. 29, 2007

(51) Int. Cl.
*G06Q 30/00* (2012.01)

(52) U.S. Cl.
USPC ..... 705/26.2; 705/26.1; 705/26.7

(58) Field of Classification Search
USPC ..... 705/26.1–27.2
See application file for complete search history.

(56) References Cited

U.S. PATENT DOCUMENTS

| | | | | |
|---|---|---|---|---|
| 5,960,407 | A | 9/1999 | Vivona | 705/10 |
| 6,101,484 | A | 8/2000 | Halbert et al. | 705/26 |
| 6,604,089 | B1 | 8/2003 | Van Horn et al. | 705/26 |
| 6,631,356 | B1 | 10/2003 | Van Horn et al. | 705/26 |
| 6,847,938 | B1 | 1/2005 | Moore | 705/26 |
| 6,915,274 | B2 | 7/2005 | Abhyanker | 70/26 |
| 6,934,690 | B1 | 8/2005 | Van Horn et al. | 705/26 |
| 2002/0032668 | A1 | 3/2002 | Kohler et al. | 705/401 |
| 2002/0046128 | A1 | 4/2002 | Abe et al. | 705/26 |
| 2002/0069117 | A1 | 6/2002 | Carothers et al. | 70/26 |
| 2002/0123937 | A1 | 9/2002 | Pickover et al. | 705/26 |
| 2003/0023505 | A1 | 1/2003 | Eglen et al. | 705/26 |
| 2003/0028394 | A1 | 2/2003 | Alzer et al. | 705/1 |
| 2003/0061119 | A1 | 3/2003 | Kocher | 705/26 |
| 2003/0061150 | A1 | 3/2003 | Kocher | 705/37 |
| 2003/0078858 | A1 | 4/2003 | Angelopoulos et al. | 705/26 |
| 2003/0200151 | A1 | 10/2003 | Ellenson et al. | 705/26 |
| 2004/0049444 | A1 | 3/2004 | Sato | 705/37 |
| 2004/0138962 | A1 | 7/2004 | Kopelman et al. | 705/26 |
| 2004/0172335 | A1 | 9/2004 | Batoff | 705/22 |
| 2005/0071249 | A1 | 3/2005 | Nix et al. | 705/26 |
| 2005/0102189 | A1 | 5/2005 | Lopez et al. | 705/26 |
| 2005/0289017 | A1 | 12/2005 | Gershom | 705/26 |

(Continued)

OTHER PUBLICATIONS

"Billy McNair, CEO of PeerFlix," BestOfBusinessInterviews.com, accessed Apr. 17, 2006, from http://www.bestofbusinessinterviews.com/billy_mcnair.htm, 5 pages.

(Continued)

*Primary Examiner* — Michael Misiaszek
(74) *Attorney, Agent, or Firm* — Seed IP Law Group PLLC

(57) ABSTRACT

Techniques are described for facilitating transactions involving items and users in various ways. In some situations, item transactions are coordinated by an automated Item Transaction (or "IT") system provided via one or more computing systems, such that users of the IT system who have available items are matched with other users of the IT system who desire those items. The types of items being involved in transactions via the IT system may vary, and in some situations may include items such as music CDs, video DVDs, computer games, computer software, etc. The operation of the IT system may be enhanced in various ways, including by selecting appropriate users to receive opportunities to sell items available from those users, such as in a manner to balance supply and demand for items, and by notifying the selected users of those opportunities.

28 Claims, 10 Drawing Sheets

(56) References Cited

U.S. PATENT DOCUMENTS

| | | | | |
|---|---|---|---|---|
| 2005/0289039 | A1 | 12/2005 | Greak | 705/37 |
| 2006/0026077 | A1* | 2/2006 | Silverman et al. | 705/26 |
| 2008/0222065 | A1* | 9/2008 | Kedrowski et al. | 706/19 |

OTHER PUBLICATIONS

"Hitflip: Swap DVDs and audiobooks Instead of Renting Them! The Large Swapping platform," Hitflip (formerly Swopex), accessed May 16, 2007, from http://www.hitflip.co.uk/about-us.html, 2 pages.
"Swopex Launches Online DVD Swapping Site for The UK," Sep. 27, 2005, PRNewswire, accessed Apr. 17, 2006, from http://www/prnewswire.co.uk/cgi/news/release?id+154635, 1 page.
"Tired of your DVDs? Swap 'em online: Peerflix matches buyers and sellers for 99 cents a trade," Reuters, MSNBC.com, Sep. 19, 2005, accessed Nov. 8, 2005, from http://www.msnbc.msn.com/id/9400475/print/1/displaymode/1098/, 2 pages.
"Traders Trade 2001 Archives," accessed Apr. 24, 2006, from http://www.traderstrade.com/2001/, 11 pages.
Barterbee.com, Catch the Buzz and Pass it On!, accessed Apr. 17, 2006, from http://www.barterbee.com/, 1 page.
Barterbee.com, Getting Points, accessed Apr. 17, 2006, from http://www.barterbee.com/xmain0003/?_hp=point, 1 page.
Barterbee.com, How to Buy, accessed Apr. 17, 2006, from http://www.barterbee.com/xmain0003/?_hp=buy, 1 page.
Barterbee.com, How to Sell, accessed Apr. 17, 2006, from http://www.barterbee.com/xmain0003/?_hp=sell, 1 page.
Borland, J., "Moogul Wants You to Share Your Shovel," Jul. 9, 2004, accessed Apr. 17, 2006, from http://news.com/2102-1032_3-5262592.html?tag=st.util.print, 2 pages.
Boudreau, J., "Start-up to Offer CD-Swap Network," Mar. 7, 2006, Mercury News, accessed Apr. 17, 2006, from http://www.mercurynews.com/mld/mercurynews/business/14037158.htm, 2 pages.
Claburn, T., "Peerflix Launches Peer-To-Peer DVD Service," Sep. 20, 2005, InformationWeek, accessed Apr. 2, 2007, from http://www.informationweek.com/showArticle.jhtml?articleID=170704717, 5 pages.
Cook, J., "Venture Capital: Where Mercata Led, Consumers Were Unwilling to Follow," Jan. 12, 2001, Seattle Post-Intelligencer, accessed Apr. 5, 2006, http://seattlepi.nwsource.com/printer/index.asp?ploc=b, 4 pages.
Dean, K., "Swap DVDs Online for a Buck," Jun. 1, 2005, Wired News, accessed Apr. 17, 2006, from http://www.wired.com/news/digiwood/1,67656-1.html, 5 pages.
eBay.com, Search: Find Items, accessed Jan. 31, 2007, from http://search.ebay.com/ws/search/AdvSearch?sofocus=bs&sacat=-1&catref=C5&from=R7&nojsp, 2 pages.
Erento.com, "Rent, Hire, Rental, Borrow, Share—Erento," accessed Apr. 17, 2006, from http://www.erento.com/rent/, 2 pages.
Erento.com, "Erento—Mieten Und Vermieten—Neu Bei Erento?," accessed Jun. 7, 2007, from http://www.erento.com/mieten/index.php?action=hilfe_01 and translated by http://babelfish.altavista.com/babelfish/tr, 1 page.
Festa, P., "Consumer Sites Adopt Barter Model," c/net News.com, accessed Apr. 24, 2006, from http://news.com.com/2102-1017_3-235886.html?tag=st.util.print, 3 pages.
Kanellos, Michael, "DVD swap site switches from credits to cash," CNET News.com, Dec. 17, 2006, accessed Dec. 18, 2006, from http://msn-cnet.com.com/2102-1038_3-6144169/html?tag=st.util.print, 2 pages.
Lala.com, "How it Works," accessed Jan. 25, 2007, from http://www.lala.com/frontend/action/howitworks, 1 page.
Lala.com, Help, accessed Jan. 25, 2007, from http://www.lala.com/frontend/action/help, 3 pages.
Lala.com, Store, accessed Jan. 25, 2007, from http://www.lala.com/frontend/action/store, 2 pages.
Lala.com, Want List, accessed Jan. 25, 2007, from http://www.lala.com/frontend/action/wantlist, 1 page.
Mediachest.com, "Mediachest FAQ", accessed Apr. 17, 2006, from http://www.mediachest.com/help/faq.html, 2 pages.
Mediachest.com, homepage, accessed Apr. 17, 2006, from http://www.mediachest.com/, 1 page.
MYDREW.com, "How It Works . . . ", accessed May 16, 2007, from http://www.mydrew.com/help/how_it_works.htm, 3 pages.
MYDREW.com, homepage, accessed May 16, 2007, from http://www.mydrew.com, 5 pages.
Netflix.com, "How It Works,", accessed Aug. 15, 2006, from http://www.netflix.com/HowItWorks?1nkctr=nmhhiw, 2 pages.
Peerflix.com, Community—"Cranky Goat's Profile", accessed Jan. 24, 2007, from http://peerflix.com/community/members/grid.jsf?tab=about&id=48034, 1 page.
Peerflix.com homepage, "DVDs: Buy Trade Used DVD Movies Online," accessed Aug. 15, 2006, from http://www.peerflix.com, 1 page.
Peerflix.com, "About Peerflix,", accessed Feb. 14, 2006, from http://www.peerflix.com/Default.aspx?tabid=69, 2 pages.
Peerflix.com, "DVDs: Trade Used DVD Movies Online," accessed Aug. 15, 2006, from http://www.peerflix.com/Default.aspx?tabid=64, 2 pages.
Peerflix.com, "Peerflix: No DVD Rentals! Trade Your DVDs—> Details: How Does It Work," accessed Feb. 14, 2006, from http://www.peerflix.com/Default.aspx?tabid=64, 2 pages.
Peerflix.com, "Welcome to the New Peerflix!" accessed Jan. 24, 2007, from http://www.peerflix.com/registration/trader1.jsf, 2 pages.
Peerflix.com, Browse DVDs—"Runaway Bride(1999)", accessed Jan. 30, 2007, from http://www.peerflix.com/catalog/catalog/detail.jsf?id73042, 1 page.
Peerflix.com, Browse DVDs—DVD Details—"Runaway Bride(1999)", accessed Jan. 24, 2007, from http://www.peerflix.com/catalog/catalog/detail.jsf?id=73042, 1 page.
Peerflix.com, Browse DVDs, accessed Jan. 30, 2007, from http://www.peerflix.com/catalog/browse.jsf, 1 page.
Peerflix.com, My Peerflix—Haves, accessed Jan. 24, 2007, from http://www.peerflix.com/mypeerflix/grid.jsf?tab=mydvds&subtab=haves&refresh=true, 1 page.
Peerflix.com, My Peerflix—To Mail, accessed Jan. 26, 2007, from http://www.peerflix.com/mypeerflix/mailitnow.jsf, 1 page.
Peerflix.com, My Peerflix—Wants, accessed Jan. 24, 2007, from http://www.peerflix.com/mypeerflix/grid.jsf?tab=mydvds&subtab=wants, 1 page.
Peerflix.com, Peerflix Help—Getting Started, accessed Jan. 24, 2007, from http://www.peerflix.com/help/index.jsf, 2 pages.
Peerflix.com, Peerflix Help—Shipping, accessed Jan. 26, 2007, from http://www.peerflix.com/help/index.jsf, 3 pages.
Peerflix.com, Peerflix Help—What Changed?, accessed Jan. 24, 2007, from http://www.peerflix.com/help/index.jsf, 6 pages.
Peerflix.com, Peerflix How it Works, accessed Jan. 24, 2007, from http://www.peerflix.com/help/index.jsf;jsessionif=55e6fd23201ff4c1043435631f6a?section=howi, 1 page.
Shepard, G., "Peer-To-Peer Movies With Peerflix," Mar. 11, 2005, SiliconBeat, accessed Apr. 2, 2007, from http://www.siliconbeat.com/entries/2005/03/10/peertopeer_movies_with_peerflix.html, 4 pages.
SonicSwap.com, "Frequently Asked Questions," , accessed Apr. 17, 2006, from http://www.sonicswap.com/SiteInformation/faqs.jsp?MemberID=, 3 pages.
SwapSimple.com, Browse Items Available for Trade on SwapSimple.com (by 1st letter of title) [?], accessed Apr. 14, 2006, from http://swapsimple.com/browse/dvd/F_/list.do, 2 pages.
SwapSimple.com, homepage, accessed Apr. 14, 2006, from http://swapsimple.com/, 2 pages.
SwapSimple.com, Welcome to the SwapSimple Trading Community, accessed Apr. 14, 2006, from http://swapsimple.com/how_swapsimple_works.jsp, 2 pages.
SwitchDiscs.com, "About SwitchDiscs.com", accessed Apr. 14, 2006, from http://www.switchdiscs.com/about.php, 2 pages.
Swopex.com, "Frequently Asked Questions," accessed May 16, 2007, from http://web.archive.org/web/20051013084607/http://www.swopex.com/pages/faq/, 13 pages.

(56) References Cited

OTHER PUBLICATIONS

TitleTrader.com, FAQs, accessed Apr. 5, 2006, from http://titletrader.com/faqs.php, 2 pages.
TitleTrader.com, homepage, accessed Apr. 5, 2006, from http://titletrader.com/, 2 pages.
TitleTrader.com, Premium Features, accessed Apr. 5, 2006, from http://titletrader.com/premium.php, 2 pages.
TradeAway.com, "Why Trade?," accessed Apr. 5, 2006, from http://www.tradeaway.com/abouttrade.phtml, 4 pages.
TradeAway.com, homepage, accessed Apr. 5, 2006, from http://www.tradeaway.com, 2 pages.
U-Exchange.com, Business Barter for Goods and Services, accessed Apr. 5, 2006, from http://www.u-exchange.com/businessbarter.asp, 2 pages.

* cited by examiner

Customer Database (as of current time of 5:00pm on 3/8/XY)

210

| | 212a ID | 212b Name | 212c Address | 212d Date Joined | 212e Items Received | 212f Items Provided | 212g Most Recent System Interaction | 212h Frequency Of System Interaction | ... |
|---|---|---|---|---|---|---|---|---|---|
| 214a | 0001 | Customer AAA | Address AAA | 1/12/XX | 17 | 23 | 3/7/XY | 1.1 | |
| 214b | 0002 | Customer BBB | Address BBB | 10/1/XX | 12 | 5 | 3/8/XY | 0.29 | |
| 214c | 0003 | Customer CCC | Address CCC | 2/3/XX | 0 | 1 | 1/15/XY | 0 | |
| 214d | 0004 | Customer DDD | Address DDD | 4/7/XX | 19 | 35 | 3/8/XY | 5 | |
| 214e | 0005 | Customer EEE | Address EEE | 12/5/XX | 5 | 0 | 3/1/XY | 0.5 | |
| | | ⋮ | | | | | | | |

Item Database

220

| | 222a ID | 222b Name | 222c Item Type | 222d Date Released | 222e Current Desired Listings | 222f Current Availability Listings | 222g Total Transactions | 222h Recent Transactions | ... |
|---|---|---|---|---|---|---|---|---|---|
| 224a | 1001 | Item WWW | DVD | 3/1/XX | 1 | 40 | 52 | 4 | |
| 224b | 1002 | Item XXX | DVD | 3/1/XY | 133 | 0 | 2 | 2 | |
| 224c | 1003 | Item YYY | CD | 5/22/XX | 2 | 7 | 10 | 1 | |
| 224d | 1004 | Item ZZZ | DVD | 6/12/XX | 4 | 1 | 30 | 0 | |
| 224e | 1005 | Item VVV | DVD | 7/12/XX | 18 | 24 | 456 | 35 | |
| | | ⋮ | | | | | | | |

Available Item Database

230

| | 232a Customer ID | 232b Item ID | 232c Item Name | 232d Quantity | ... |
|---|---|---|---|---|---|
| 234a | 0001 | 1001 | Item WWW | 2 | |
| 234b | 0001 | 1003 | Item YYY | 1 | |
| 234c | 0001 | 1124 | Item RRR | 1 | |
| | | ⋮ | | | |

Desired Item Database

240

| | 242a Customer ID | 242b Item ID | 242c Item Name | 242d Quantity | ... |
|---|---|---|---|---|---|
| 244a | 0001 | 1002 | Item XXX | 1 | |
| 244b | 0001 | 1004 | Item ZZZ | 1 | |
| 244c | 0001 | 1125 | Item SSS | 1 | |
| | | ⋮ | | | |

Figure 2

300

305 Welcome Customer AAA! Please update your list of desired items below.

315 ALERTS

Customer AAA, one or more of the items on your Available Item List are in demand by other users, and you have the opportunity to provide them to the other users if you wish.

Click here to see your Available Item List.

320 YOUR DESIRED ITEM LIST

| | Item Type | Item Name | Quantity | Remove |
|---|---|---|---|---|
| 320a | DVD | Item ZZZ | 1 | ◊ |
| 320b | CD | Item SSS | 1 | ◊ |
| 320c | DVD | Item XXX | 1 | ◊ |

325 Add New Items:

Item Name and/or Item ID Number of copies Add 325a 325b 325c 325d

Figure 3A

Customer Supply Opportunity Notification Database (as of current time of 5:00pm on 3/8/XY)

330

| | 332a ID | 332b Customer Name | 332c Time Of Notification | 332d Exclusivity Ends | 332e Item Supply Opportunity Ends | 332f Active | 332g Supplier Notification Weight | ... |
|---|---|---|---|---|---|---|---|---|
| 334a | 0001 | Customer FFF | 3/8/XY 3:00pm | 3/9/XY 3:00pm | 3/10/XY 3:00pm | X | 1.0 | |
| 334b | 0002 | Customer BBB | 3/8/XY 8:00am | 3/9/XY 8:00am | 3/10/XY 8:00am | X | 0.74 | |
| 334c | 0003 | Customer CCC | 3/7/XY 6:00pm | 3/8/XY 6:00pm | 3/9/XY 6:00pm | X | 0.5 | |
| 334d | 0004 | Customer DDD | 3/7/XY 6:00pm | 3/8/XY 6:00pm | 3/9/XY 6:00pm | X | 0.5 | |
| | | ⋮ | | | | | | |
| 334e | 0005 | Customer EEE | 3/6/XY 4:30pm | 3/7/XY 4:30pm | 3/8/XY 4:30pm | - | 0 | |
| | | ⋮ | | | | | | |

Figure 3B

Information About Item Availability Of Customers

| 340 | | 342a | 342b | 342c | 342d | 342e | 342f | 342g | 342h |
|---|---|---|---|---|---|---|---|---|---|
| | | **Item YYY** | **Item WWW** | **Item TTT** | **Item ZZZ** | **Item VVV** | **Item UUU** | **Item RRR** | **Item SSS** |
| 344a | Customer FFF | X | - | - | - | - | - | X | X |
| 344b | Customer BBB | - | - | X | - | X | - | X | X |
| 344c | Customer CCC | X | - | - | X | X | - | - | - |
| 344d | Customer DDD | X | X | X | - | X | - | X | X |
| | | ⋮ | | | | | | | |
| 344e | Customer AAA | X | X | - | - | - | - | X | - |
| 344f | Customer EEE | - | X | - | - | - | - | - | - |
| 344g | Customer GGG | X | - | X | - | X | - | X | - |
| 344h | Customer HHH | X | - | - | - | - | - | - | X |
| 344i | Customer III | X | X | X | - | X | X | - | X |

Information About New Customer Notification Selection

| 350 | | 352a | 352b | 352c | 352d | 352e | 352f | 352g | 352h | 352i |
|---|---|---|---|---|---|---|---|---|---|---|
| | | | | | | | *customer notification effect on ratio* | | | |
| | | **Aggregate Demand** | **Aggregate Supply** | **Current Actual Notification** | **Current Target Notification** | **Notification Supply Ratio** | **AAA** | **GGG** | **HHH** | **III** |
| 354a | Item YYY | 3 | 7 | 2.0 | 4 | -0.50 | - | - | - | - |
| 354b | Item WWW | 1 | 40 | 1.6 | 2 | -0.20 | -0.20 | 0 | 0 | -0.20 |
| 354c | Item TTT | 5 | 83 | 6.1 | 6 | 0.02 | 0 | 0.02 | 0 | 0.02 |
| 354d | Item VVV | 18 | 24 | 26.3 | 22 | 0.20 | 0 | 0.20 | 0 | 0.20 |
| 354e | Item UUU | 4 | 17 | 6.9 | 5 | 0.38 | 0 | 0 | 0 | 0.38 |
| 354f | Item RRR | 6 | 9 | 8.5 | 8 | 0.06 | 0.06 | 0.06 | 0 | 0 |
| 354g | Item SSS | 2 | 10 | 5.7 | 3 | 0.90 | 0 | 0 | 0.90 | 0.90 |
| | | | | | | *Total* | -0.14 | 0.28 | 0.90 | 1.30 |

Figure 3C

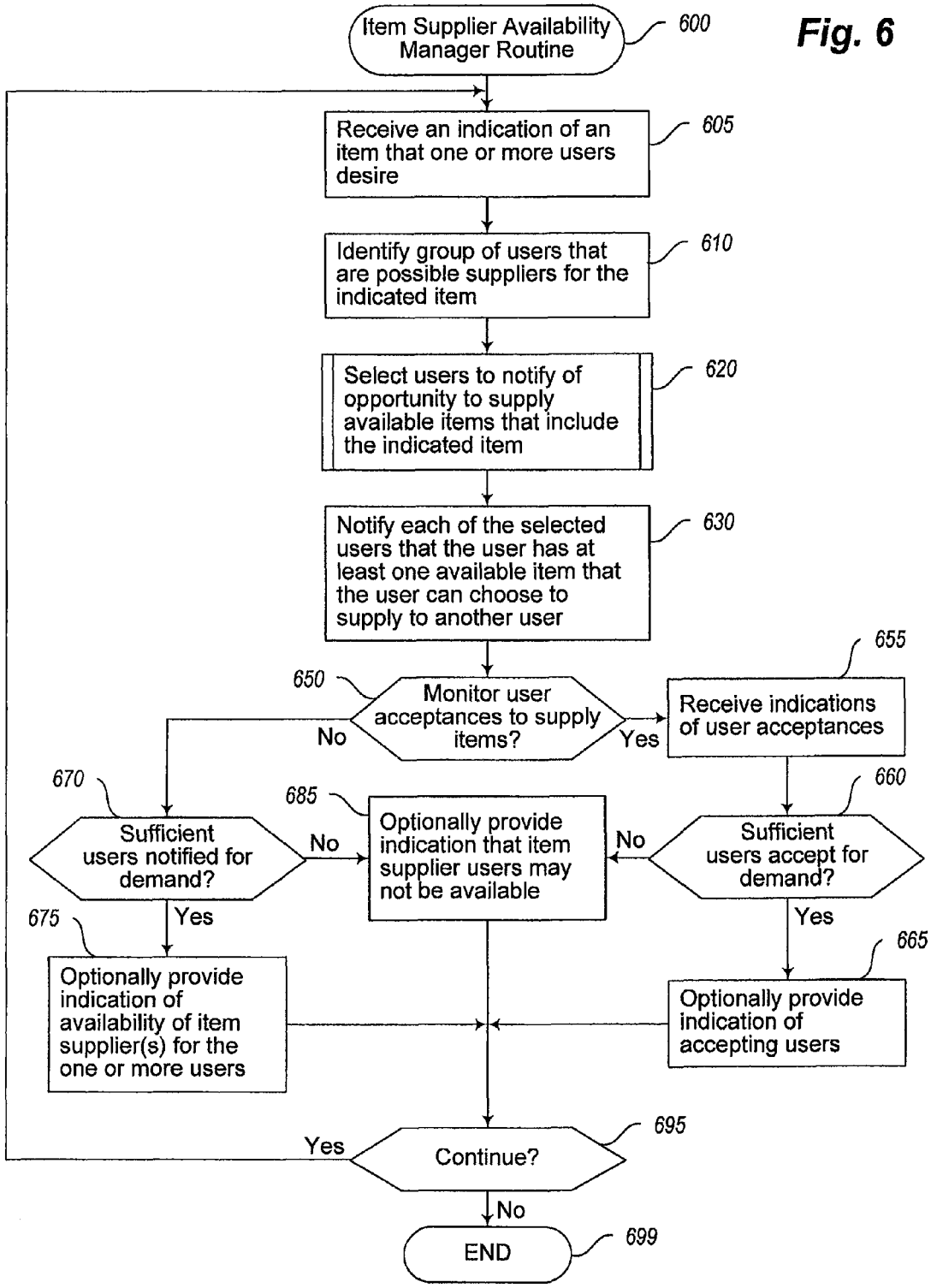
Item Supplier Availability Manager Routine
600
Fig. 6
Receive an indication of an item that one or more users desire
605
Identify group of users that are possible suppliers for the indicated item
610
Select users to notify of opportunity to supply available items that include the indicated item
620
Notify each of the selected users that the user has at least one available item that the user can choose to supply to another user
630
650
Monitor user acceptances to supply items?
No
Yes
655
Receive indications of user acceptances
670
Sufficient users notified for demand?
No
685
Optionally provide indication that item supplier users may not be available
No
660
Sufficient users accept for demand?
Yes
675
Yes
Optionally provide indication of availability of item supplier(s) for the one or more users
665
Optionally provide indication of accepting users
Yes
Continue?
695
No
END
699

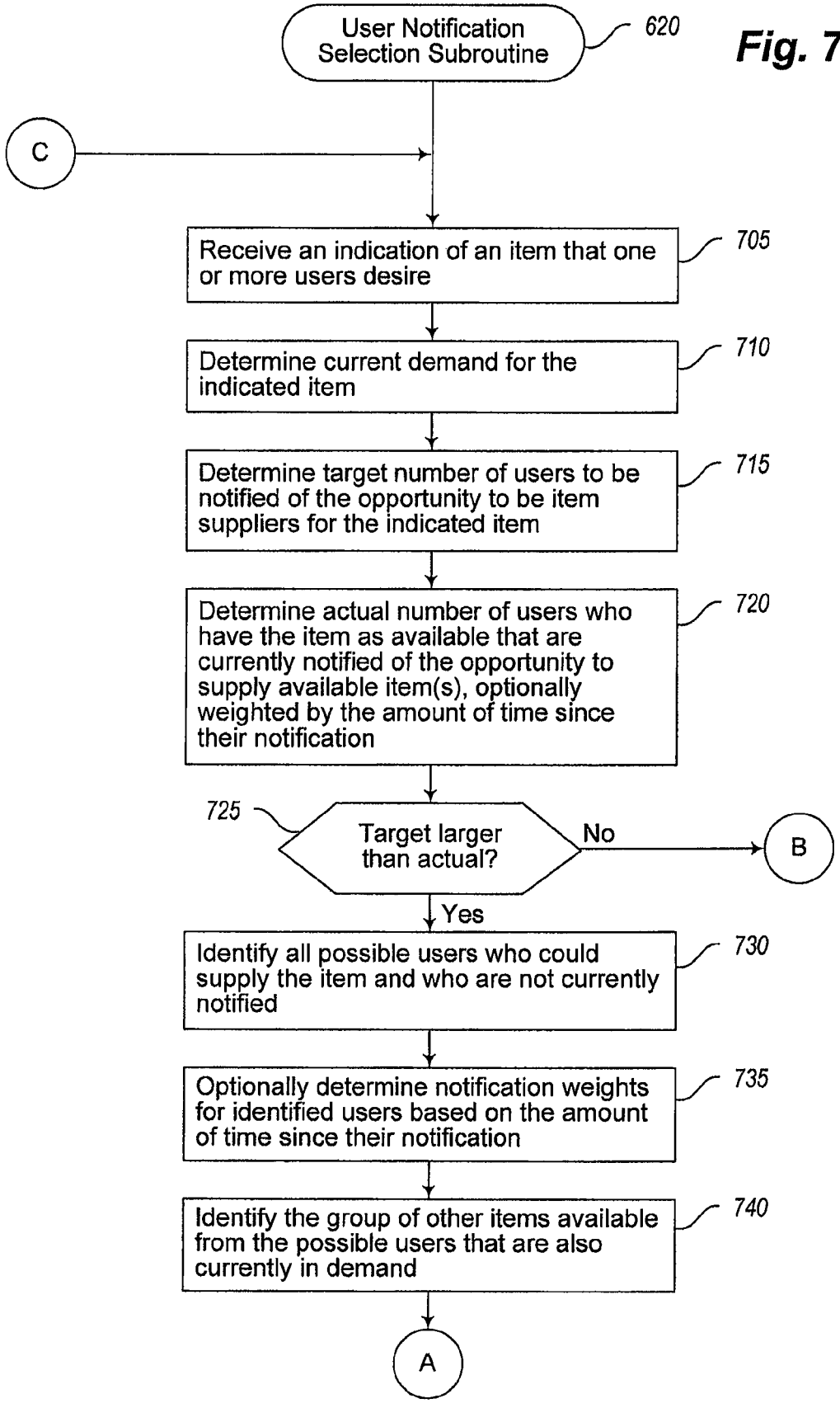
User Notification Selection Subroutine
620
Fig. 7A
C
Receive an indication of an item that one or more users desire
705
Determine current demand for the indicated item
710
Determine target number of users to be notified of the opportunity to be item suppliers for the indicated item
715
Determine actual number of users who have the item as available that are currently notified of the opportunity to supply available item(s), optionally weighted by the amount of time since their notification
720
725
Target larger than actual?
No
B
Yes
Identify all possible users who could supply the item and who are not currently notified
730
Optionally determine notification weights for identified users based on the amount of time since their notification
735
Identify the group of other items available from the possible users that are also currently in demand
740
A

FACILITATING TRANSACTIONS INVOLVING ITEMS BY NOTIFYING SELECTED USERS OF DEMAND FOR ITEMS

TECHNICAL FIELD

The following disclosure relates generally to facilitating transactions involving buying items from users and selling items to users, such as to assist users participating in an item transaction system.

BACKGROUND

The Internet comprises a vast number of computers and computer networks that are interconnected through communication links, with access to information being provided using various services such as electronic mail ("email") and the World Wide Web (also referred to as the "Web"). In addition to providing access to information, the Web has increasingly become a medium that is used to search for, shop for and order items (such as products, services and/or information) that are for purchase, rent, lease, license, trade, evaluation, sampling, subscription to, etc. In many circumstances, a user can visit the Web site of a Web merchant (or a "Web store") or otherwise interact with an online retailer or electronic marketplace that provides one or more items, such as to view information about the items, give an instruction to place an order for one or more items, and provide information needed to complete the purchase (e.g., payment and shipping information). The Web merchant then fulfills the order by providing the ordered items to the indicated recipient, such as by providing product items that have been ordered through physical distribution channels (e.g., shipment via a governmental postal service or private common carrier) or electronically (e.g., via download over the Internet, such as for digital music or videos) as appropriate. Ordered service items may similarly be provided electronically (e.g., providing email service) or physically (e.g., performing cleaning services at the purchaser's house).

Some Web sites have arisen that allow users to sell items to and purchase items from each other, such as DVD movies, audio CDs, or video games. A user will typically register to become a customer by entering personal information, such as the user's name, mailing address and payment information. Once registered, the customer can interact with other customers to provide or receive items. For example, a customer may be able to specify items that (s)he would like to receive from others and/or items that (s)he is willing to provide to others. When a match between two customers is made for a particular item, the customer who has the item provides it to the other customer who would like to receive it, typically based on some form of compensation given to the customer providing the item (e.g., monetary payment, "points" or other form of credit tracked by the Web site, etc.). Similarly, the customer who receives an item typically provides some form of compensation for receiving the item. The operator of such a Web site may in some cases obtain revenue in various ways, such as by charging a fee for each item transaction, by charging a fee for membership, etc.

However, various problems exist with such Web sites for facilitating transactions involving items and users. One such problem results from difficulties in appropriately balancing user supply and demand for items. For example, if several users each desire a copy of an item that is available from a large number of other users, such Web sites typically have difficulties in ensuring that the users who desire the item each receive a copy in a timely manner without notifying an excess number of the users who have the available item copies. If too few of the users who have the available item copies are notified (or if the notified users do not respond in a timely manner), then insufficient copies of the item will be supplied for the users who desire item copies, resulting in customer dissatisfaction among the users who do not receive items. Conversely, if too many of the users who have the available item copies are notified (e.g., all of them), many of the notified users will be unable to actually supply their item copies in response to the notification because other notified users have already met the demand for the item, resulting in customer dissatisfaction among those users.

Thus, it would be beneficial to provide techniques to facilitate transactions involving items and users, as well as to provide other benefits.

BRIEF DESCRIPTION OF THE DRAWINGS

FIG. 2 illustrates examples of types of tracked information about items and users of an item transaction system.

FIGS. 3A-3C illustrate examples of selecting appropriate users to notify of an opportunity to supply available items to other users who desire the items.

FIG. 6 is a flow diagram of an example embodiment of an Item Supplier Availability Manager routine.

FIGS. 7A and 7B are a flow diagram of an example embodiment of a User Notification Selection subroutine.

DETAILED DESCRIPTION

Techniques are described for facilitating transactions involving items and users in various ways. In some embodiments, the item transactions are coordinated by an automated Item Transaction (or "IT") system provided via one or more computing systems, such that users of the IT system who have available items are matched with other users of the IT system who desire those items. By matching users, item transactions may occur via the IT system. For example, the IT system may engage in a purchase transaction to purchase an item from a user who has the item available and also engage in a sales transaction to sell the same purchased item to a user who desires the item. In at least some embodiments, transactions involving items and users are facilitated by selecting appropriate users to receive opportunities to sell items available from those users, such as in a manner to balance supply and demand for items, and by notifying the selected users of those opportunities, as described in greater detail below.

Figure 1:
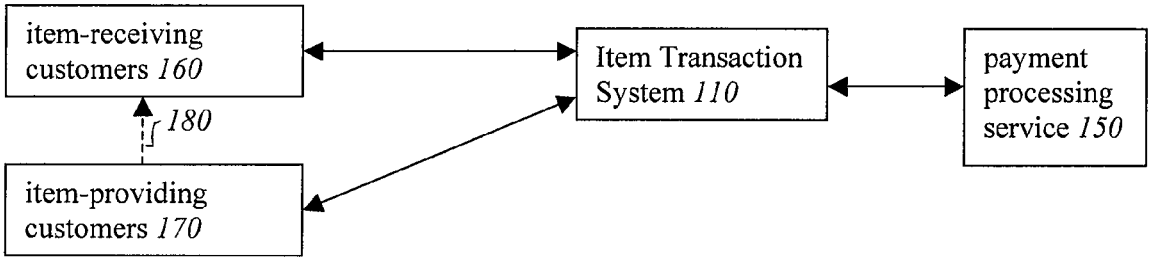
FIG. 1 illustrates an example embodiment of an item transaction system capable of interacting with customers to provide the described techniques.

FIG. 1 illustrates an example of an environment in which an embodiment of the IT system may operate. In this example, the IT system is illustrated as an Item Transaction System 110 executing on one or more computing systems (not shown). The IT system 110 facilitates transactions involving items and users who are customers of the IT system, and in particular facilitates transactions in which items are sent from various item-providing customers 170 to various item-receiving customers 160. The types of items involved in transactions via the IT system may vary, and in some embodiments may include items of one or more item types such as music CDs, DVDs, computer games, computer software, video games, books, articles of clothing, shoes, fashion accessories, photographs, magazines or other printed materials, posters, works of art, furniture, cooking recipes, rare collectibles, electronics or computer hardware, etc.

Transactions between customers of the IT system may be initiated in various ways. For example, after an item-receiving customer makes a request to the IT system for a copy of an indicated item, the IT system may determine whether one or more item-providing customers have indicated that they have a copy of the requested item available. If so, the IT system in this example purchases a copy of the item from one of the item-providing customers, sells the purchased copy of the item to the item-receiving customer, and sends directions to the item-providing customer to send the purchased item to the requesting item-receiving customer.

In some embodiments, the IT system may first verify that the item-providing customer is willing to sell the copy of the item. For example, if multiple customers are able to sell a copy of the item, the IT system may indicate the opportunity to sell the item to some or all of the item-providing customers who are able to sell a copy of the item (e.g., along with timing-related or other constraints regarding how and/or when the item is to be sent to the requesting customer). After one of the item-providing customers agrees to sell a copy of the item to the requesting customer (e.g., the first one that agrees), the IT system 110 would then send directions to that item-providing customer to send a copy of the item to the requesting item-receiving customer. The sending of items between customers may occur in various ways, such as via a direct transport 180 between the customers (e.g., via the postal service, a private delivery company, physical meeting of the customers, etc.), or instead with the IT system or another entity acting as an intermediary (not shown). While the previous item transaction example was initiated when an item-receiving customer requested an item from the IT system, such an item transaction may similarly be initiated when an item-providing customer indicates to the IT system that the customer has an available copy of an item, and the IT system indicates the opportunity to purchase the item to some or all item-receiving customers.

The illustrated IT system may also perform various other actions, such as tracking and using various information about the customers and their activities. For example, the IT system may track current "points" or other credits provided by the IT system, such as points that are credited by the IT system to customers who sell items and that are debited by the IT system from customers who buy items. In addition, while illustrated here as separate groups for the sake of clarity, it will be appreciated that at least some of the customers of the IT system may be both item-providing customers and item-receiving customers, such as for different items and by interacting with other customers. Furthermore, the customers 160 and 170 may interact with the IT system and optionally each other in various ways (not shown), such as via a Web site provided by the IT system and/or by using other electronic communications methods (e.g., email, telephone, text messaging, instant messaging, SMS, MMS, etc.).

In this example, the IT system 110 is operated by a merchant (not shown), and is electronically interacting with another affiliated system that may also optionally be operated by the merchant or instead by a third-party operator. In this example, the other affiliated system is a payment processing service 150 that processes indicated payments on request, such as from and/or to customers. In other embodiments, the IT system may instead include its own payment processing capabilities. In addition, in at least some embodiments, the IT system operation may be enhanced in various ways via interactions with one or more other types of affiliated systems, such as external item marketplaces (not shown) operated by the merchant and/or by third-party operators. Interactions with such external marketplaces may include, for example, automatically obtaining and using information related to users of the IT system from those marketplaces (e.g., if the IT system users are also users of the external marketplace), and/or by acquiring additional items or item information from those marketplaces for use by the IT system. Such external marketplaces may include new item marketplaces that sell new items of one or more types to customers (e.g., via a Web store, physical brick-and-mortar retail stores, physical or electronic auction sites, etc.) and/or used item marketplaces that sell used items of one or more types to customers.

In some embodiments, the IT system may charge a transaction fee to customers under certain circumstances, such as to each customer who receives an item through the IT system (e.g., in addition to points or other credits that are debited from the customer receiving the item). If so, the IT system interacts with the payment processing service 150 in this example to obtain the appropriate transaction fees from the customers, including to obtain pre-paid transactions fees in certain circumstances. For example, the customers may have previously interacted with the IT system (e.g., during a customer registration process) to specify one or more fee payment mechanisms that the payment processing service is directed to use, such as a credit card, bank account, or other source of funds.

As previously noted, in at least some embodiments, the IT system facilitates item transactions by identifying item-providing customers that have available copies of a requested item, and notifying some of those item-providing customers of an opportunity to sell the requested item. More generally, in at least some embodiments, the IT system facilitates item transactions by first determining an appropriate number of item-providing customers to be notified in order to provide a current level of supply of an item that corresponds to a current level of demand for the item. For example, in some embodiments the IT system may determine a desired target number of users to be notified of an opportunity to provide copies of a particular item, such as by selecting a target number of users that exceeds a number of item-receiving customers that desire the item by a specified amount. The specified amount of additional item-providing customers to notify may be selected based on an expectation that some of the notified item-providing customers will not respond to the opportunity that they receive to supply their copy of the particular item, with the specified amount able to be determined in various ways (e.g., as a percentage of the level of demand, such as an additional 20%).

After determining an appropriate target number of item-providing customers to be notified for a particular requested item, particular item-providing customers to be notified may be selected in various ways. In at least some embodiments, item-providing customers to be notified are selected based on the items that those item-providing customers have available, such as by selecting item-providing customers that have an available copy of the requested item and whose other available items will best balance the supply and demand for items requested by item-receiving customers. For example, if a first potential item-providing customer to be notified has available items for which the current demand exceeds the current supply (based on the notified item-providing customers that currently have an opportunity to supply available items), while a second potential item-providing customer to be notified has available items for which the current supply exceeds the current demand, the first item-providing customer will be selected to be notified in order to better balance the overall supply and demand for items. After the particular item-providing customers have been selected, those item-providing customers may be notified of a current opportunity to supply available items in various ways. Additional details related to functionality for selecting users to receive opportunities to supply their available items and for notifying selected users are included below.

For illustrative purposes, some embodiments are described below in which specific types of items are involved in transactions between users in specific ways, and in which an item transaction system facilitates such item transactions in various ways (e.g., in which item transactions occurring via the IT system involve the IT system purchasing an item from a first user and selling the item to a second user). However, it will be appreciated that the described techniques may be used in a wide variety of other situations, including with other types of items, and that the invention is not limited to the exemplary details provided.

FIG. 2 illustrates examples of types of tracked information about items and users of an embodiment of the IT system, such as for use in selecting appropriate users to be notified of opportunities to supply items that the users have available. In particular, FIG. 2 illustrates various example information about customers of an embodiment of the IT system and about items included in transactions involving the customers. In this example, the customer-related information includes a portion of a customer database 210 used by the IT system to track information about users of the IT system, with each of the rows 214*a-e* representing a distinct customer user. Various information is illustrated for each customer in this example, including a unique identifier ("ID") 212*a*, a name 212*b*, an address 212*c*, a date 212*d* of becoming a customer, the cumulative number of items received by the customer 212*e*, the cumulative number of items provided by the customer 212*f*, the most recent interaction by the customer with the IT system 212*g*, the frequency of interactions by the customer with the IT system 212*h* (e.g., during a period of time of interest, such as the last week, month or year), etc. In this example, the information in the customer database reflects a snapshot of information as of 5 pm on a date of 3/8/XY, such that a user with a most recent system interaction of 3/7/XY interacted with the IT system on the prior day. A variety of other types of information about users may similarly be tracked in at least some embodiments, including various user preference information (e.g., related to item relevance measures preferred by the user).

In this example, various item-related information is also illustrated, including a portion of an item database 220 used by the IT system to track items involved in transactions via the IT system, with each of the rows 224*a-e* representing a distinct item. Various information is illustrated for each item in this example, including a unique identifier ("ID") 222*a*, name 222*b*, item type 222*c*, item release date 222*d*, the total current number of requests for the item by customers 222*e* (e.g., by a customer adding the item to a desired items list for the customer), the total current number of offers of the item by customers as being available to other customers 222*f* (e.g., by a customer adding the item to an available items list for the customer), the total number of transactions 222*g* involving the item, and the number of recent transactions 222*h* involving the item (e.g., transactions during a past week or month). The total current number of requests 222*e* for an item represents a current level of demand for the item via the IT system, and the total current number of offers of the item as being available 222*f* represents a current level of supply of the item via the IT system. For example, item WWW is shown in entry 224*a*, and has 40 current availability listings and 1 current desired listings. As such, the current aggregate supply for this item greatly exceeds the current aggregate demand for this item, such that any user supplying a new request for the item will have a large number of users available to provide the item. The other example items XXX, YYY, ZZZ and VVV shown in rows 224*b*-224*e* have other varying degrees of current aggregate demand and supply, with the current aggregate demand greatly exceeding the current aggregate supply for item XXX, the current aggregate supply and demand for items YYY and ZZZ being similar and being low, and the current aggregate supply and demand for item VVV begin similar but being relatively high. The numbers of total and recent transactions for the items also vary, and a variety of other types of information about items may similarly be tracked in at least some embodiments (e.g., total cumulative aggregate demand, total cumulative aggregate supply, and various item attributes, such as genre, actors, artists, directors, producers, etc.).

In this example, information is also illustrated about current supply and demand for various items by customers of the IT system. In particular, in this example current aggregate supply of items in the IT system is based on customers that have added items to their available item lists at the IT system, and who have not yet provided those items to other customers via the IT system. Similarly, current aggregate demand of items in the IT system is based on customers that have added items to their desired item lists at the IT system, and who have not yet received those items from other customers via the IT system. The illustrated information includes a portion of an available item database 230 used by the IT system to track items currently on customers' available item lists, and a portion of a desired item database 240 used by the IT system to track items currently on the customers' desired item lists. In the example, the illustrated portions of the databases 230 and 240 reflect portions of the available item list and desired item list of a single user, that being Customer AAA (whose customer information is shown in row 214*a* of database 210), and most of the example items have corresponding information in the item database 220. A variety of other types of information that is not illustrated may be tracked and used in at least some embodiments, including details about particular item transactions (e.g., for each transaction, the one or more items involved, the customer(s) who provided the item(s) for the transaction, and the customer(s) who received the item(s) for the transaction), and about user accounts (e.g., about payment information, address information, etc.).

The various item-related and customer-related information illustrated in FIG. 2 may be used in various ways to select appropriate users to be notified of opportunities to supply items that the users have available, as discussed in greater detail with respect to FIGS. 3A-3C. In particular, FIG. 3A provides an example of information that may be provided to a user to inform the user of an opportunity to supply available items, with the information being provided to Customer AAA in this example. FIGS. 3B-3C illustrate examples of types of information used to select Customer AAA as a user to be notified in this example.

FIG. 3A illustrates an example of a user interface screen 300 being displayed to user Customer AAA (e.g., as part of a Web page) to allow the user to review and optionally modify the current desired item list of the user, such as after the user requested the information (e.g., by selecting a link or other user-selectable control on a home page or other information page provided by the IT system). The displayed information includes instructions 305, information 320 about Customer AAA's desired item list, and controls 325 to add items to the desired item list. In this example, Customer AAA has three items on the desired item list, as indicated by entries 320*a*-320*c*, and desires one copy of each of the items. User-selectable controls are also displayed for each item on the desired item list to remove those items from the list. In other embodiments, a variety of additional types of information may be displayed or available, such as information to assess the relevance of particular items with respect to one or more selected relevance assessment measures.

In addition, in this example FIG. 3A includes information 315 to provide an alert to user Customer AAA, with the alert indicating that the user has an opportunity to supply one or more items on the user's available item list to other users. The alert information in this example does not indicate which item(s) on the user's available item list is currently in demand. In other embodiments, the provided information may have other forms and/or include other types of information, such as one or more such expiration times related to the user's opportunity (e.g., an expiration time until which the user's opportunity to supply an available item is exclusive, is guaranteed, and/or will remain available; an indicated future time after which the user's opportunity to supply an available item is reduced or otherwise diminished, such as if the opportunity might cease to exist or might be restricted in one or more manners at any time after that future time depending on the actions of other users and/or on other factors; etc.), other conditions related to the opportunity being provided, and/or an identification of one or more of the user's available items to which the opportunity applies. In this example, the user may obtain additional information about the current opportunity by viewing the user's available item list (e.g., by selecting the included user-selectable control to view the available item list), from which the user may select one or more of the user's available items to be supplied to one or more other users (e.g., in the illustrated example, to select any available item that is currently in demand from one or more other users). In other embodiments, such alert information may be provided in a variety of ways and at various times, including on a first user interface page or screen that the user receives from the IT system when beginning a new interaction session, and on some or all subsequent interface pages or screens that the user receives.

While not illustrated here, information similar to or identical to that of information 315 may be used to notify the user of the currently available opportunity to supply one or more available items, whether instead of or in addition to the alert information 315 being displayed to the user. For example, such information may in some embodiments be sent to the user as part of one or more electronic messages, such as an email, instant message, SMS or other text message, telephone call, via desktop icon or other desktop display mechanism, etc. As with the information 315, the information provided as part of the notification may have various forms and/or include other types of information, including one or more expiration times and other information related to availability of the opportunity, an identification of one or more of the user's available items to which the opportunity applies, etc. In addition, the type of notification electronic message that is used for a user and/or the type of information provided to a user may be based at least in part on previously specified preferences of the user. Furthermore, in some embodiments the actual information that is sent may be tailored to the type of electronic message, such as to include a user-selectable control that the user may select for response if the message type allows such controls (e.g., HTML-based email).

It will be appreciated that the various sections of the example user interface shown in FIG. 3A may be omitted or rearranged or adapted in various ways in other embodiments, and that additional types of information may be added. Furthermore, additional user interface screens provided by an embodiment of the IT system may display a variety of additional types of information to users. In addition, in some embodiments such information may be presented or otherwise provided to customers in other ways (e.g., via email, instant message, SMS, telephone call, via desktop icon or other display, etc.).

FIGS. 3B-3C illustrate examples of types of information used to select Customer AAA for notification in this example. In particular, FIG. 3B illustrates a portion of a database 330 with information about prior opportunities provided to users to supply available items. For example, the database 330 may include information indicating when users are informed of opportunities via one or more notification electronic messages. Each of the rows 334*a*-*e* of the database 330 represents a distinct item supply opportunity provided to a user. Various information is illustrated for each opportunity in this example, including a unique identifier 332*a* of the customer user that receives the opportunity, a name 332*b* of the customer, a time 332*c* of the notification of the opportunity, a time 332*d* at which the opportunity exclusivity ends, a time 332*e* at which the opportunity's temporary availability to a user ends, an indication 332*f* whether the opportunity is currently available to the user (i.e., whether the time in column 332*e* has passed), and a weight 332*g* between 0 and 1 that reflects an amount of time that has passed since notification of the opportunity occurs. In this example, the exclusivity of a user's opportunity ends 24 hours after notification, and the availability of the temporary opportunity ends 48 hours after notification. After exclusivity of a user's opportunity ends, there may no longer be any items on the user's available item list that remain available to be supplied to other users (e.g., no items for which current demand continues to exist), and after availability of a user's opportunity ends (or if an opportunity is never provided to the user), the user may not be allowed to supply items on the user's available item list even if current demand exists for the item. The weight 332*g* for an opportunity is used when determining how many users currently have an opportunity to supply a particular item, as discussed in greater detail later. In this example, as with the information illustrated in FIG. 2, the information in the database 330 reflects a snapshot of information as of 5 pm on a date of 3/8/XY, such that opportunities that occurred after 5 pm on 3/6/XY are currently active and available to their users. A variety of other types of information about opportunities may similarly be tracked in at least some embodiments, including types of notification mechanisms used, whether the user is known to have received and/or reviewed the notification, any conditions related to the opportunity, particular items (if any) to which the opportunity applies, etc. Conversely, in at least some embodiments some of the illustrated types of information may not be included, such as if opportunities do not have periods of exclusivity and/or do not expire.

In this example, the information about previously notified opportunities may be used in various ways. For example, when selecting between multiple possible users to receive an item supply opportunity, in some embodiments information about some or all prior opportunities provided to the users may be used (e.g., to give preference to a user if the user has not recently received an opportunity, such as to increase the chance that all users receive opportunities; to give preference to users based on their responses to prior opportunities, such as if the user responded promptly or at all; etc.). In addition, in the illustrated embodiment, when identifying possible users to receive a new item supply opportunity, users who have currently available item supply opportunities are not considered (in this example, the users indicated in rows 334*a*-334*d* are not available to be considered, while other users including the user indicated in row 334*e* are available for consideration). This exclusion of users with currently available item supply opportunities in the illustrated embodiment is based on those item supply opportunities being made available for all items on a user's available item list—in such an embodiment, providing another opportunity to such a user while a previous opportunity is still available would not change the current supply of any of the user's available items, since the user is already able to supply any of those items for which current demand exists. In other embodiments in which item supply opportunities are limited to particular items, however, a currently available opportunity may be excluded for current consideration for an item only if the opportunity applies to the item.

FIG. 3C illustrates additional information used to select Customer AAA for notification in this example, based in part on other information shown in the example databases 210, 220, 230 and 330 of FIGS. 2 and 3B. In particular, in this example, the IT system has received an indication that demand for Item YYY by users of the IT system has increased by 1. In response, the IT system determines whether to select one or more additional users who have Item YYY as an available item to receive an opportunity to supply their available items to others, and if so to determine which additional users to select. As reflected in row 224*c* of database 220 of FIG. 2 that reflects the state of the IT system before the demand increase, the current aggregate demand for Item YYY is now 3 copies of the item, and the current aggregate supply of Item YYY continues to be 7 copies of the item. The increase in demand for Item YYY may be triggered in various ways, such as by a user adding Item YYY to his/her desired item list. In addition, the IT system may determine to select users to be notified of item supply opportunities at various times, such as the following: after every increase in demand for an item; after any change in supply of and/or demand for an item; after a change in supply of and/or demand for an item that is sufficiently large (e.g., that exceeds a predetermined threshold); after a period of time has expired, such as once a day, every 4 hours, a specified amount of time since a prior selection of users to be notified, or upon expiration of an exclusivity and/or availability period for one or more previously notified item supply opportunities; etc.

In order to determine whether to select additional users to be notified, the IT system in this example embodiment first determines a desired target amount of supply for Item YYY, and then determines an actual amount of supply for Item YYY. If the target amount of supply exceeds the actual amount of supply, one or more users who have Item YYY available may be selected to be notified of an item supply opportunity so that the actual amount of supply for Item YYY increases to the target amount of supply. The desired target amount of supply for Item YYY is based on a current amount of demand for Item YYY, as indicated by a number of users who desire Item YYY. In this example, the target number is selected to be the number of desired item copies plus an additional 20%, rounding up to the next number, although the target number may be determined in other manners in other embodiments. Thus, with 3 desired copies of Item YYY, the target number in this example is determined to be 4 (3+3*20%=3.6).

Next, the current available supply of Item YYY is determined, based on the actual number of users who have Item YYY available that are currently notified of an available opportunity to supply items. Database 330 of FIG. 3B indicates users that have currently available opportunities to supply items, and rows 344*a*-344*d* of information 340 of FIG. 3C provide details regarding at least some of the items that those users currently have available. Currently, three users (corresponding to users Customer FFF, Customer CCC and Customer DDD in rows 344*a*, 344*c* and 344*d*) have a currently available opportunity to supply items and have Item YYY available. In the example embodiment, the determination of the current available supply of Item YYY is further performed so as to consider an amount of time since the users with Item YYY available have been notified of their available item supply opportunity. For example, the supplier notification weights of column 332*g* of database 330 may be used as part of determining the amount of current available supply, resulting in this example of a current available supply of Item YYY of 2.0 (1*1.0+1*0.5+1*0.5=2.0). Accordingly, a determination is made to select 2 additional users to be notified if possible. In this example, user notification weights decrease over time after a user is notified of an opportunity to supply available items, such as to reflect a decreasing likelihood that the user will respond to the opportunity and supply available items. The particular weights are determined in this example by having the weight for an opportunity decline from 1.0 to 0.9 after an initial 3-hour period from the notification of the opportunity, and then decline by 0.02 for each additional hour during the 48 hours of availability of the opportunity. Such weights may be determined in a variety of other manners in other embodiments.

Since it is determined in this example to notify at least one additional user who has Item YYY available of an opportunity to supply available items, the IT system gathers information about users that do not have a currently available opportunity to supply available items as possible candidates to be notified. Rows 344*e*-344*i* of table 340 indicate users who do not have a currently available opportunity to supply available items, including user Customer EEE in row 344*f* who recently had an item supply opportunity end (as indicated in row 334*e* of FIG. 330). However, since Customer EEE does not have an available copy of Item YYY, as indicated in column 342*a* of table 340, Customer EEE will not be considered as a potential additional user to notify. Instead, the additional user(s) to notify will be selected from those users who have a copy of Item YYY available and do not have a currently available opportunity to supply items, which in this example are the four users Customers AAA, GGG, HHH and III.

In order to select between the four possible users that are identified, the IT system in this example embodiment next considers the effect of providing an item supply opportunity to each of those users on the supply and demand for items other than Item YYY. In this example, columns 342*b*-342*c* and 342*e*-342*h* of table 340 each correspond to an item other than Item YYY that is available from at least one of the 4 users identified as possible additional users to be notified, so as to indicate which of these other items each of the 4 users currently has available to supply. Item ZZZ indicated in column 342*d* is available from one of the users that already has a currently available item supply opportunity, but is not available from any of the 4 possible additional users, and thus that item will not be considered when selecting between the 4 users.

After determining the possible additional users and the items that those users have available, the information 350 is generated for the users and items to determine the effect of providing an item supply opportunity to each of those users on the supply and demand for items other than Item YYY. Row 354*a* provides summary information related to Item YYY, and rows 354*b*-354*g* each correspond to one of the items other than Item YYY that are available from at least one of the possible additional users (as previously indicated in columns 342*b*-342*c* and 342*e*-342*h* of table 340). Columns 352*a*-352*e* of the table 350 reflect information about current supply and demand for each of the items, and columns 352*f*-352*i* reflect the effect on the current supply and demand for the items if each of the 4 possible additional users is provided with an item supply opportunity. In particular, columns 352*a* and 352*b* indicate aggregate demand and supply for each item, such as to correspond to columns 222*e* and 222*f* of database 220 in FIG. 2 for some of the items. Column 352*d* indicates a current target supply of each of the items, which is determined in this example based on the aggregate demand plus an additional 20%, rounding up to the next number. Column 352*c* indicates a current actual supply of each of the items, which is determined in this example based on the number of users who have the item available and have a currently available opportunity to supply available items, weighted by the amount of time since the opportunity was made available to the user.

Column 352*e* indicates a relationship between aggregate supply and demand for each of the items, and is determined in this example embodiment in such a manner that a negative number reflects an under-supply of the item and that a positive number reflects an over-supply of the item. In particular, in this example, the actual notification number from column 352*c* is divided by the target notification number from column 352*d*, and 1 is subtracted from the result. Thus, if the actual and target notification numbers are identical (and thus aggregate supply and demand is equal), the result of dividing the actual and target numbers is 1, and the final result is 0 after 1 is subtracted. In this example, Item WWW in row 354*b* is under-supplied, and the other items in rows 354*c*-*g* are over-supplied. If one of the possible users has an available item that is under-supplied, then providing an opportunity to supply available items to that user will improve the balance of supply and demand for that item. Conversely, if one of the possible users has an available item that is over-supplied, then providing an opportunity to supply available items to that user will make the balance of supply and demand for that item worse. Thus, in this example embodiment, the possible users are selected based on their effect on the over-supply and under-supply of their available items over than Item YYY. Furthermore, by considering current supply based on prior item supply opportunities provided to users, the IT system may incrementally select additional users to notify in a manner that reflects the previously selected and notified users.

In this example, for user Customer AAA reflected in column 352*f*, the user has available items that include Item WWW and Item RRR (as indicated in the available item database 230 of FIG. 2). Accordingly, by providing an opportunity to supply available items to Customer AAA, the under-supply of Item WWW will be improved, while the slight over-supply of Item RRR will be worsened. This is reflected in column 352*f* by indicating the notification supply relationship number from column 352*e* for each item that Customer AAA has, and totaling the numbers at the bottom (in this example, a number is not indicated for Item WWW, as all of the identified possible users have Item WWW available). In this example, Customer AAA has a total effect of −0.14 if provided an opportunity to supply available items, based on the −0.20 under-supply of Item WWW and the 0.06 over-supply of Item RRR. Similar numbers are indicated in columns 352*g*-352*i* for Customers GGG, HHH and III, with all of the other users having positive total effect numbers. Since a negative number in columns 352*f*-352*i* indicates an improvement in under-supply, while a positive number indicates a worsening in over-supply, the smallest number possible is preferred. It will be appreciated that if a user who is available to supply item YYY has no other available items to supply, that user (not shown here) will have no effect on the over-supply or under-supply of other items being supplied, and thus will have a score of 0 in this example. In other embodiments, such users could instead be allocated a selected negative score if they are preferred for other reasons, or a selected positive score if they are not preferred for other reasons. Thus, if only one additional user is selected to be notified of an opportunity to supply available items (based on the target number of users to be notified exceeding the prior actual number of notified users by one), Customer AAA will be selected, and will be notified of the opportunity. If a second additional user is selected, Customer GGG will be selected, since the total effect of notifying Customer GGG on the small over-supply of Customer GGG's three other available items (Items TTT, VVV and RRR) is less than the total effect of notifying the next user Customer HHH based on the relatively high over-supply of the one other available item of Customer HHH (Item SSS).

By selecting users based on their effect on over-supply and under-supply of items in the manner described, additional benefits may be obtained. For example, in at least some embodiments, a goal of the user selection mechanism is that during the period of exclusivity for an opportunity, a notified user will have at least one item on the user's available item list that the user may select to provide to another user (i.e., that at least one other user currently desires that item at that time). If so, a notified user who responds to the notification during that time will not find that the user does not actually have any available items that are currently available to be supplied, and thus will not experience resulting dissatisfaction from such an occurrence. For each item on the user's available item list that is under-supplied (e.g., has a negative number in column 352*f*), the possibility that the item will remain available for the user to supply if the user so chooses is positive. Thus, by selecting a possible user to notify with a lowest total effect score, and preferably a negative total effect score indicating one or more under-supplied available items, the likelihood is increased that the notified user will have at least one item on the user's available item list that the user may select to provide to another user.

Furthermore, another technique that increases the likelihood that a notified user who responds to the notification will have one or more available items that are currently available to be supplied is based on the notification to the user indicating that demand exists for at least one of the notified user's available items without identifying which of those items are currently available. In that manner, if a first item on the user's available item list is available to be supplied at a time of providing a notification to the user but is not longer available to be supplied at a time when the user checks their available item list (e.g., due to another notified user supplying that item in the interim time), one or more other items on the user's available item list may have become available in the interim. If so, the user will be able to supply at least one of these other items, and will not be disappointed due to the inability to supply the first item.

It will be appreciated that effects on supply and demand for items may be determined in other manners in other embodiments. Furthermore, in other embodiments, other factors may be considered when selecting possible additional users to notify, whether instead of or in addition to effects on supply and demand. For example, one factor that may be considered is user-specific information related to how likely a user will respond to a provided opportunity to supply available items.

In this example, information in columns 212*g* and/or 212*h* of database 210 may be used as factors in selecting users, such as to give preferences to users who have recently interacted with the IT system and/or that have a high frequency of interacting with the IT system (e.g., over a recent period of time of interest). Similarly, in some embodiments preference may be given to preferred users, such as users that have previously provided large numbers of items to others (e.g., as reflected in column 212*f* of database 210), or that are otherwise preferred (e.g., based on paying a premium fee to receive item supply opportunity notifications or to otherwise have a preferred status). In addition, in some embodiments such preferred users may obtain other benefits, such as a guarantee of being able to provide items for a period of time while non-preferred users do not obtain the guarantee, longer periods of exclusivity or availability than non-preferred users, additional types of notification mechanisms, additional types of information included in notification messages, an ability to specify deadlines to receive desired items (e.g., such that the IT system attempts to provide sufficient item supply to meet that demand, such as by increasing the amount of additional users selected for the target amount of item supply), etc.

Figure 4:
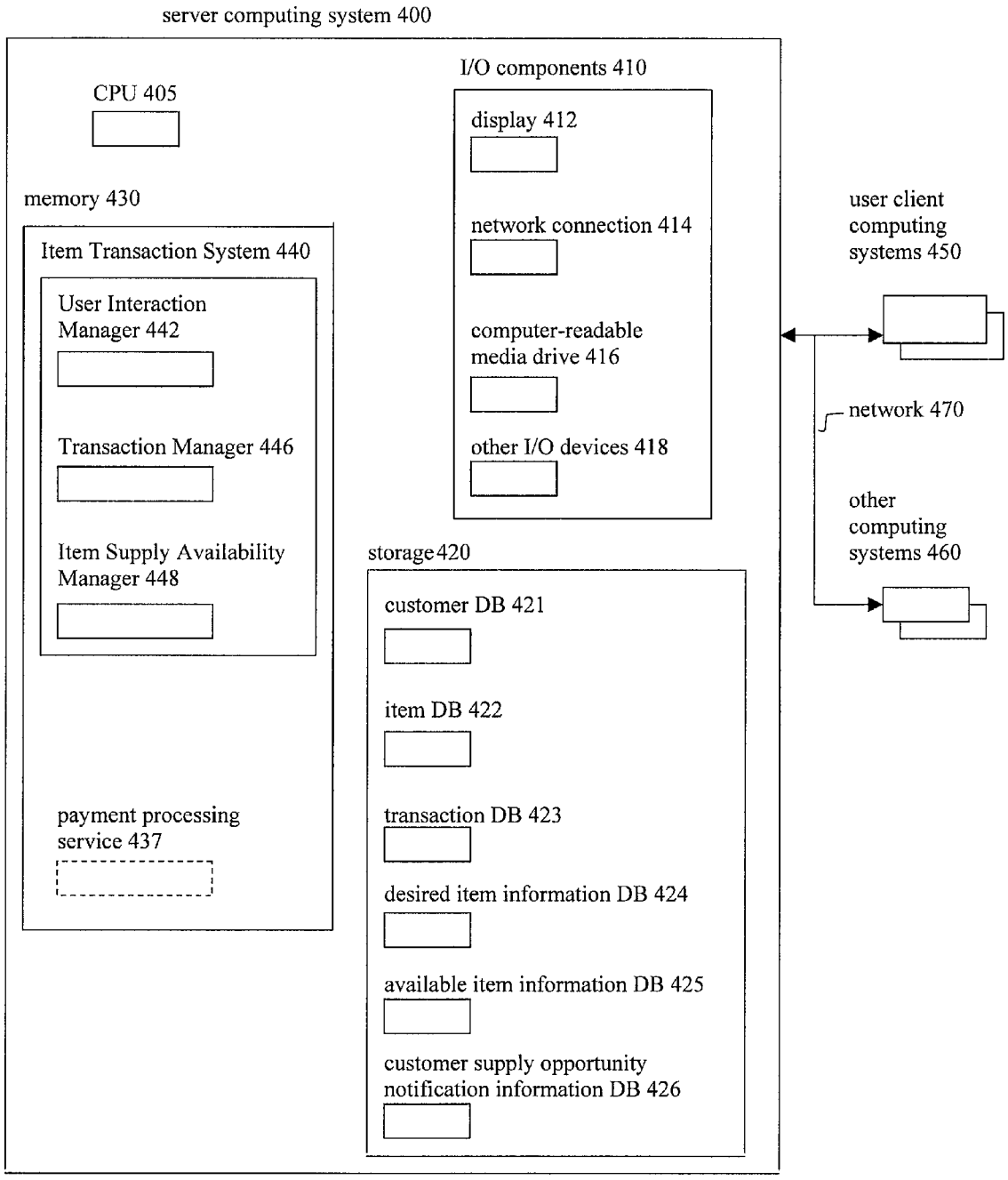
FIG. 4 is a block diagram illustrating a computing system suitable for executing an example embodiment of an item transaction system to provide the described techniques.

FIG. 4 illustrates an example server computing system 400 that is suitable for executing an embodiment 440 of the Item Transaction system. The server computing system includes a CPU 405, various input/output (I/O) components 410, storage 420, and memory 430. The illustrated I/O components include a display 412, a network connection 414, a computer-readable media drive 416, and optionally other I/O devices 418 (e.g., a keyboard, mouse, etc.). FIG. 4 also illustrates multiple client computing systems 450 that users may use to interact with the Item Transaction system via a network 470 (e.g., the Internet). The Item Transaction system may also interact over the network with one or more computing systems 460, such as to interact with other affiliated systems (e.g., one or more external item marketplaces or other external sources of information).

An embodiment of the Item Transaction system 440 is executing in memory 430, and in this example includes a User Interaction Manager component 442, an Item Supply Availability Manager component 448, and a Transaction Manager component 446. The memory 430 may also optionally include one or more other systems, such an executing payment processing service 437, or may instead interact with other such systems remotely over the network. During operation, the Item Transaction system may store and use various information on one or more databases (or other types of information stores). In this example embodiment, the storage 420 includes a customer database ("db") data structure 421, an item database data structure 422, a transaction database data structure 423, a desired item database data structure 424, an available item database data structure 425, and customer supply opportunity notification information in database data structure 426.

The User Interaction Manager component 442 interacts with users to provide various functionality, including to provide information to users about items, such as in response to user requests. In providing the information, the component 442 accesses various information about items from the item database 422, and may also access various information from the desired item and available item databases 424 and 425.

The Transaction Manager component 446 provides functionality to allow item transactions involving customer users to occur. In particular, the component identifies customers who desire items and identifies other customers who have those items available, so that the Transaction Manager component may engage in item transactions to purchase items from customers who have items available and to sell items to customers who desire items. The item transactions of the Transaction Manager component may be initiated in various ways, such as in response to requests from customers who are willing to provide items, in response to requests from customers who desire to receive items, and/or by analyzing desired item lists and available item lists to identify matches. The Transaction Manager component may also take various additional actions to facilitate the item transactions, such as by obtaining any corresponding fees and other payments (e.g., based on interactions with the payment processing service 437), managing any points being credited or debited, providing instructions and/or shipping materials to enable the item transactions to occur, and tracking the progress of the item transactions. The component 446 may further in some embodiments facilitate item transactions by taking physical custody of items being provided from customers and then providing those items to the customers who desire to receive them, while in other embodiments may instead instruct customers providing items to directly provide those items to the customers receiving items. In performing its operations, the component 446 may access and use information from the available item information database 425 and desired item information database 424, and may store information regarding item transactions in the transaction database 423 on storage 420.

The Item Supply Availability Manager component 448 facilitates item transactions between customer users by selecting appropriate users to receive opportunities to provide items available from those users, such as in a manner to balance supply and demand for items, and by notifying the selected users of those opportunities. As discussed in greater detail elsewhere, a determination to select users may be initiated in various ways, such as based on changes in supply and/or demand (e.g., based on user interactions with the User Interaction Manager component 442). In addition, the selection of which users to notify of an item supply opportunity may be made in various ways. In performing its operation, the component 448 may use various information about customers and items from the databases 421-425. In addition, the component 448 may generate various information related to its user selection determination and may store that information in database 426, such as information about over-supply and under-supply of particular items that are available from particular users, and about the effect of providing item supply opportunities to various users on the over-supply and under-supply of items. As previously noted, the notifications performed by the component 448 may have various forms, such as based on various types of electronic messages (not shown) that are sent to the users being notified.

It will be appreciated that computing systems 400, 450 and 460 are merely illustrative and are not intended to limit the scope of the present invention. An embodiment of the Item Transaction system may instead be executed by multiple interacting computing systems or devices, and computing system 400 may be connected to other devices that are not illustrated, including through one or more networks such as the Internet or via the World Wide Web ("Web"). More generally, a "client" or "server" computing system or device may comprise any combination of hardware or software that can interact, including (without limitation) desktop or other computers, network devices, PDAs, cellphones, wireless phones, pagers, electronic organizers, Internet appliances, television-based systems (e.g., using set-top boxes and/or personal/digital video recorders), and various other consumer products that include appropriate inter-communication capabilities. In addition, the functionality provided by the discussed system components may in some embodiments be combined in fewer components or distributed in additional components. Similarly, in some embodiments the functionality of some of the components may not be provided as part of the Item Transaction system and/or other additional functionality may be available.

It will also be appreciated that, while various items are discussed or illustrated as being stored in memory or on storage while being used, these items or portions of them may be moved between memory and other storage devices for purposes of memory management and data integrity. Alternatively, in other embodiments some or all of the software components may execute in memory on another device and communicate with the illustrated computing system via inter-computer communication. Some or all of the system components and/or data structures may also be stored (e.g., as software instructions or structured data) on a computer-readable medium, such as a hard disk, a memory, a network, a tangible transmission carrier, or a portable media article to be read by an appropriate drive or via an appropriate connection. The system components and data structures may also be transmitted via generated data signals (e.g., as part of a carrier wave or other analog or digital propagated signal) on a variety of computer-readable tangible transmission mediums, including wireless-based and wired/cable-based mediums, and can take a variety of forms (e.g., as part of a single or multiplexed analog signal, or as multiple discrete digital packets or frames). Such computer program products may also take other forms in other embodiments. Accordingly, the present invention may be practiced with other computer system configurations.

Figure 5:
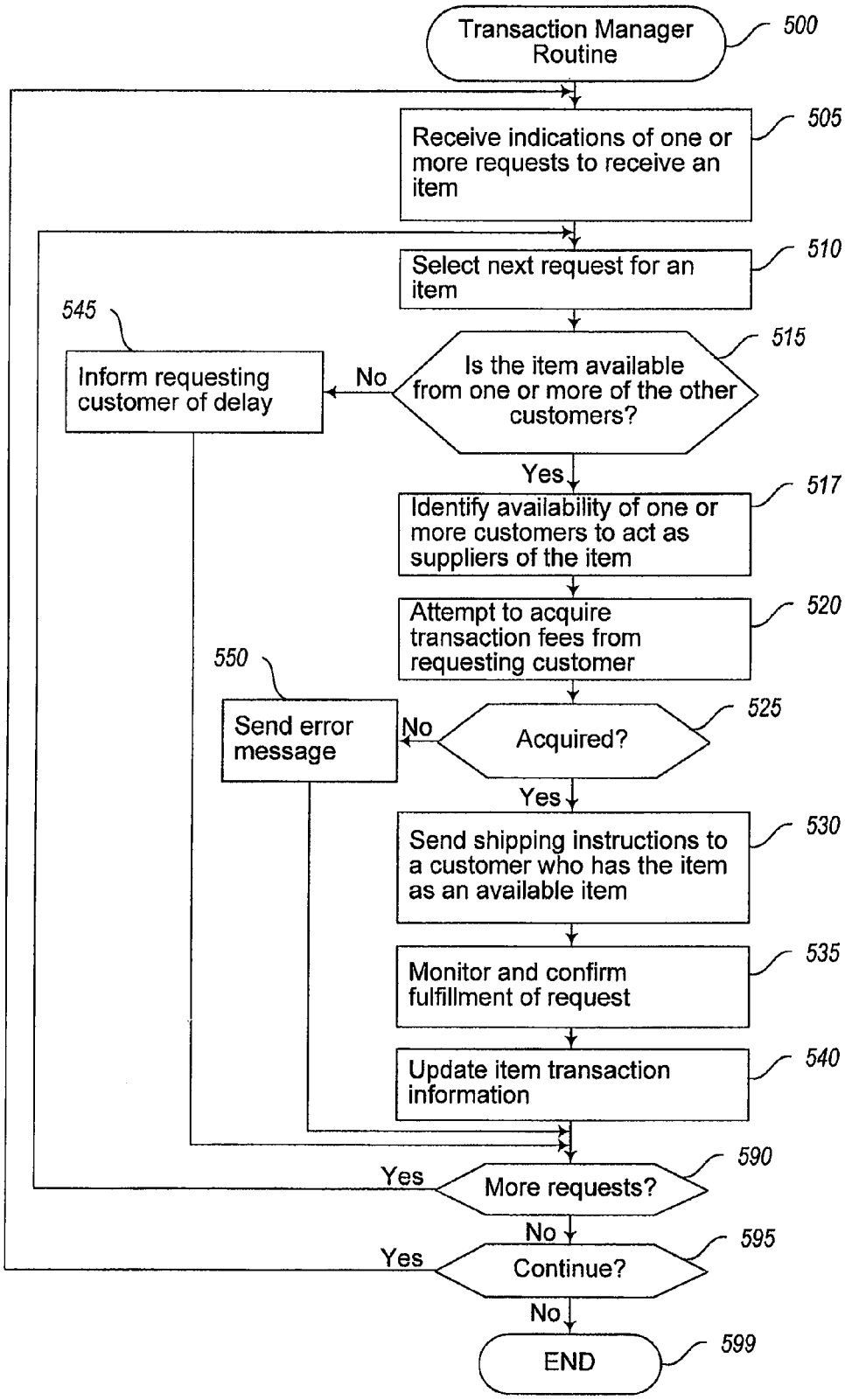
FIG. 5 is a flow diagram of an example embodiment of a Transaction Manager routine.

FIG. 5 is a flow diagram of an embodiment of the Transaction Manager routine 500. The routine may be performed by, for example, execution of the Transaction Manager component 446 of FIG. 4, such as to facilitate item transactions between customers of the IT system. In this example embodiment, the routine is initiated by a request from a customer who desires an item (e.g., by placing the item on the desired item list of the customer), although in other embodiments may be initiated in other manners.

The routine begins at block 505, where an indication is received of one or more requests made by one or more customers of the IT system of items desired to be received. The routine then continues to block 510 to select a next request to be processed, beginning with the first. The routine continues to block 515 to determine whether at least one copy of the item requested is available from one or more of the other customers of the IT system. If so, the routine proceeds to block 517 to identify whether one or more customers have the item available to participate in the transaction, such as by soliciting one or more such users regarding their interest in participating. After it is determined that at least one such customer is available, the illustrated embodiment of the routine continues to block 520 to attempt to acquire a corresponding transaction fee for the item transaction from the requesting customer. The routine then continues to block 525 to determine whether the transaction fees were successfully acquired. If so, the routine proceeds to block 530 to initiate supply of the item to the requesting customer by sending shipping instructions to a customer who has a copy of the item available. In other embodiments, the routine may instead not attempt to acquire transaction fees before initiating the providing of an item to the user, such as if the requesting customer will later be billed (e.g., if multiple fees are aggregated and billed together). The routine continues to block 535 to monitor and confirm that the request was fulfilled and that the requesting customer received a copy of the item. The routine continues to block 540 to update the stored IT system information to reflect the transaction.

After block 540, the routine proceeds to block 590 to determine whether there are more item requests to be processed. If so, the routine returns to block 510 to select the next item request, and if not continues to block 595 to determine whether to continue. If it is determined in block 595 to continue, the routine returns to block 505, and if not proceeds to block 599 and ends.

If in block 515 it is instead determined that no copy of the item is available from another customer of the IT system, the routine proceeds to block 545 to inform the requesting customer that there may be a delay in fulfilling the customer's request for the item. In some embodiments, additional blocks may be taken, such as to initiate a decision by the Item Supply Availability Manager component as to whether to notify additional users of an opportunity to supply the item, and/or one or more other actions (e.g., to otherwise inject additional copies of the item; to provide information to the requesting customer regarding alternative ways to acquire a copy of the item, such as by providing item acquisition information for one or more affiliated marketplaces; etc.). The routine then continues to block 590. If in block 525 it is instead determined that the transaction fees are not successfully acquired from the requesting customer, the routine proceeds to block 550 to send an error message to the customer. The routine then continues to block 590 to determine whether there are more item requests to be processed.

It will be appreciated that various of the illustrated types of functionality may not be provided in other embodiments, and that a variety of additional types of functionality may be available.

FIG. 6 is a flow diagram of an example embodiment of an Item Supplier Availability Manager routine 600. The routine may be performed by, for example, execution of the Item Supply Availability Manager component 448 of FIG. 4, such as to select users to be notified of item supply opportunities as appropriate and to notify selected users. In some embodiments, the routine may be initiated periodically and/or based on changes in supply and/or demand of items. In addition, in some embodiments the routine may be initiated by the Transaction Manager routine 500 of FIG. 5 at various times, such as with respect to block 517 to determine whether one or more customers are available to act as item suppliers for an item of interest, and/or with respect to block 545 to initiate additional supply of an item by selecting and notifying appropriate users.

The routine begins at block 605, where an indication is received of an item that one or more users desire. In block 610, the routine identifies a group of users that are possible suppliers for the indicated item, such as users that have the indicated item on their available item lists. The routine then proceeds to block 620 to select zero or more users to notify of an opportunity to supply available items that include the indicated item, such as by executing a subroutine described in greater detail with respect to FIG. 7. After selecting the zero or more users, the routine continues to block 630 to notify each of the selected users that the user has the opportunity to supply at least one of the user's available items to another user, such as by sending one or more electronic messages to each of the selected users.

After block 630, the illustrated embodiment of the routine continues to block 650 to determine whether to monitor if the notified users accept their opportunities to supply the item indicated in block 605. In some embodiments, such monitoring may not be performed, and if it is determined in block 650 not to perform monitoring, the routine continues to block 670 to determine if sufficient users were selected and notified in order to provide sufficient supply for the item demand. If so, the routine continues to block 675 to optionally provide an indication of availability of one or more item supplier users for the item demand, such as to provide a response if invoked in block 517 of FIG. 5. If not, the routine continues instead to block 685 to optionally provide an indication that item supplier users for the item demand may not be available, such as to provide a response if invoked in block 517 of FIG. 5.

If it is instead determined in block 650 to monitor acceptances by notified users, the routine continues to block 655 to receive indications of user acceptances to supply the item indicated in block 605. This block may involve waiting for a substantial amount of time so that users have a chance to respond to the notifications, such as until a period of availability ends for an opportunity. While illustrated here as being a synchronous block, in other embodiments the routine may continue to perform other operations (e.g., to select users to notify for other items) while waiting for user acceptances. After block 655, the routine continues to block 660 to determine whether sufficient users have accepted for the amount of demand of the item indicated in block 605. If not, the routine proceeds to block 685, and otherwise proceeds to block 665 to optionally provide an indication of availability of one or more item supplier users for the item in demand, such as to provide a response if invoked in block 517 of FIG. 5. In some embodiments, the indication of availability that is provided may further include indications of one or more particular users that have accepted to supply the item indicated in block 605.

After blocks 665, 675 or 685, the routine continues to block 695 to determine whether to continue, such as to select users as item suppliers for other items. If so, the routine returns to block 605, and if not continues to block 699 and ends.

Figure 7B:
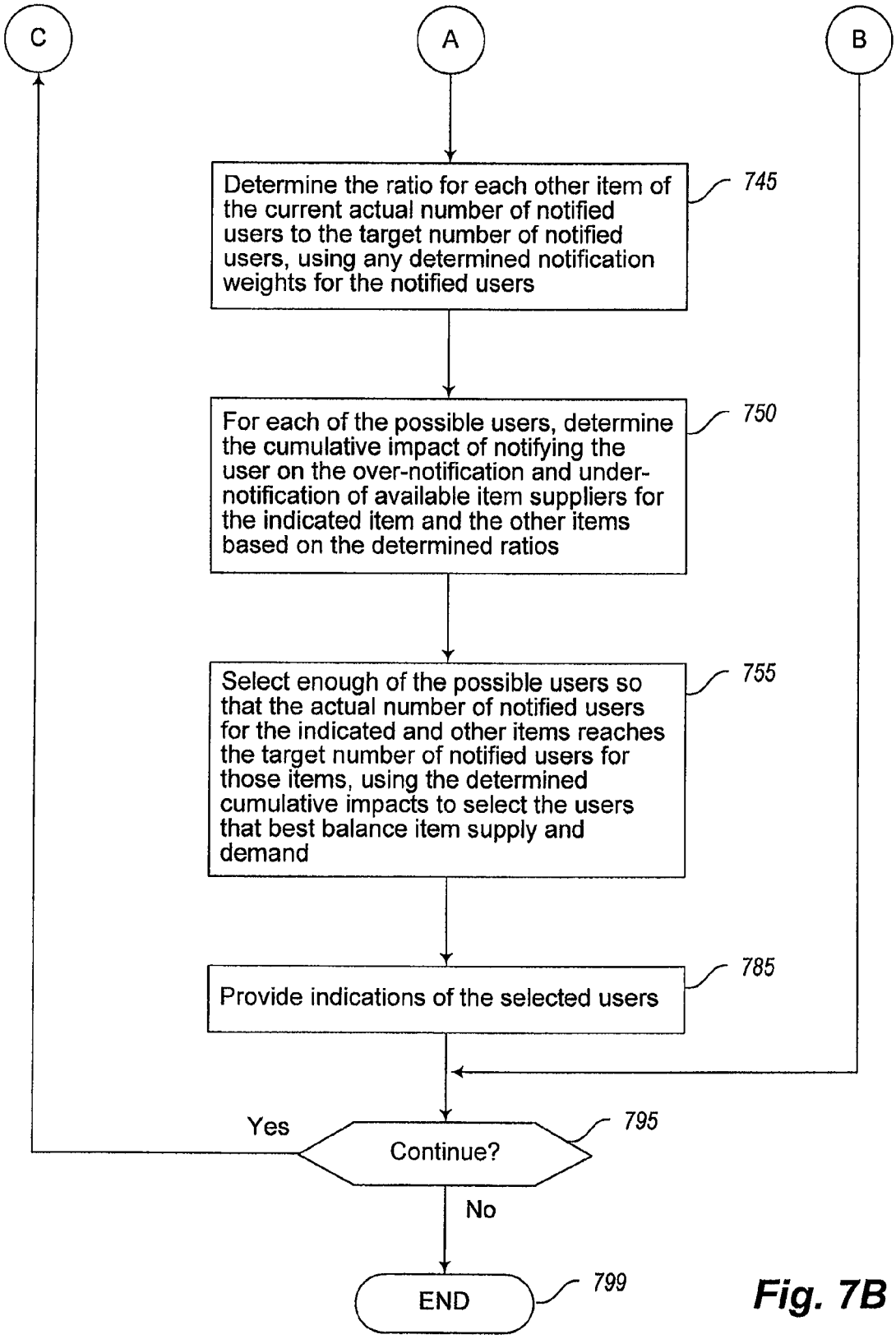

FIGS. 7A and 7B are a flow diagram of an example embodiment of a User Notification Selection subroutine 620. The subroutine may be invoked by, for example, block 620 of routine 600 of FIG. 6, such as to select users to be notified of item supply opportunities as appropriate.

The subroutine begins at block 705, where it receives an indication of an item that one or more users desire and of a group of users that are possible item suppliers for the item, such as based on those users having the item on their available item lists. The subroutine then continues to block 710 to determine current aggregate demand for the item, such as based on the number of users who have the item on their desired item lists. In block 715, the subroutine then determines a desired target number of users to be notified of a currently available opportunity to supply available items that include the indicated item, such as by selecting a target number that exceeds the current aggregate demand by a specified amount. In block 720, the subroutine then determines an actual number of users that have been notified of a currently available opportunity to supply available items that include the indicated item, optionally weighted based on recency of occurrence of the notification (e.g., to count less recently notified users less than more recently notified users). In other embodiments, weighting may not be used, or the weighting may be performed in other manners to reflect a likelihood that a particular user will respond to the provided opportunity (e.g., to reflect past behavior of the notified users, such as to count users more than average if their past behavior indicates that they are more likely than average to respond to the provided opportunity). The subroutine then continues to block 725 to determine whether the target number exceeds the actual number. If not, then no additional users need to be notified, and the routine continues to block 795. While not illustrated here, in other embodiments additional actions may be taken if the actual number of notified users exceeds the target number, such as to stimulate additional demand (e.g., by recommending the item to at least some users), to reduce the actual number of notified users (e.g., by withdrawing a currently available item supply opportunity for the indicated item from one or more users who have the opportunity, such as by notifying those users of the withdrawal), etc.

If it is instead determined in block 725 that the target number exceeds the actual number, the subroutine continues instead to block 730 to identify possible users who could supply the indicated item and who do not have a currently available opportunity to supply available items, such as by determining the users indicated in block 705 who do not have a currently available opportunity to supply available items. In block 735, the subroutine then optionally determines weights for the identified users based on the amount of time since their last notification (if any) of an opportunity to supply items, such as to give greater preference when selecting a user to receive an item supply opportunity if the user has not recently received an item supply opportunity. As discussed elsewhere, in other embodiments preferences for selecting users to receive item supply opportunities may be made in other manners (e.g., to reflect past behavior of users in responding to provided opportunities, such as to reward users who respond quickly and/or consistently), or such preferences may not be used. The subroutine continues to block 740 to identify other items that are available from the possible users identified in block 730 and are currently in demand by other users. In block 745, the subroutine then determines for each of the other items whether an over-supply or under-supply exists for the other item, such as by generating a ratio of actual to target notification for the other item, optionally using determined weights for determining the actual notification. In block 750, the subroutine then determines, for each of the possible users, the effect of providing an opportunity to the user to supply available items on the over-supply or under-supply for the other items. In block 755, the subroutine then selects one or more of the possible users to be notified so that the actual number of notified users reaches the target number if possible, using the determined effects for the possible users to determine an order for selection of the determined users such that the possible user with the largest effect on correcting under-supply and smallest effect on exacerbating over-supply is selected first. In some embodiments, additional information may be used when selecting the possible users, such as weights (if any) determined in block 735. After block 775, the subroutine provides an indication of the selected possible user(s) in block 785, and continues to block 795.

In block 795, the subroutine determines whether to continue, such as to select users to notify for additional items. If so, the subroutine returns to block 705, and if not continues to block 799 and ends.

As previously noted, a determination of whether to select users to notify of an opportunity to supply available items may be initiated in various ways, including based on an increase in user demand. An increase in user demand for an item may occur when a user indicates that the item is desired, such as by adding the item to a desired item list of the user. Similarly, an increase in user supply of an item may occur when a user indicates that the user has the item available, such as by adding the item to an available item list of the user. In some embodiments, at least some such user indications are specified during an initial user registration process provided by the IT system, such as based on user interaction with a Web site provided by the IT system. The registration process may involve the IT system obtaining information about, for example, the user's name, various contact information (e.g., home street address, telephone number, email address, etc.), and/or demographic information (e.g., age). The registration process may also involve the IT system obtaining various payment-related information for the new user, such as if users are charged monetary payments in certain circumstances (e.g., to charge a user who obtains an item from another user a monetary transaction fee, such as to cover costs of shipping or other delivery and/or as part of a fee charged by the IT system for facilitating the item transaction). Such payment-related information for a user may include information about, for example, one or more credit cards, bank accounts, electronic payment system accounts, etc. During or after the registration process, a user may also be prompted to optionally specify an available item list describing the items that the user wishes to make available to others via the IT system, and a desired item list describing the items that the user desires to receive from other users via the IT system. A variety of other types of information may similarly be specified by a user during or after the registration process (e.g., various types of feedback, such as regarding other users with whom the user conducts item transactions and/or regarding the IT system).

As previously noted, in some embodiments, item transactions that occur via the IT system include the IT system engaging in a purchase transaction to purchase an item from a user who has the item available and in a sales transaction to sell the purchased item to a matched user who desires the item. In other embodiments, item transactions may occur in a variety of other ways. For example, users may purchase and sell items to and from each other without an intermediary, such as after the IT system facilitates matches between the users for particular items. Alternatively, item transactions may occur in other manners that do not involve purchases and/or sales of items. As one example, in some embodiments, the IT system functionality may be used to implement a rental system, such that some or all users who provide items may eventually receive that item (or another copy of that item) back, such as automatically or upon request of the user. If so, at least some users who receive a desired item may eventually be requested or instructed to send that item back to the IT system and/or to the user who provided the item, such as after the customer has finished using the item.

Those skilled in the art will also appreciate that in some embodiments the functionality provided by the routines discussed above may be provided in alternative ways, such as being split among more routines or consolidated into fewer routines. Similarly, in some embodiments illustrated routines may provide more or less functionality than is described, such as when other illustrated routines instead lack or include such functionality respectively, or when the amount of functionality that is provided is altered. In addition, while various operations may be illustrated as being performed in a particular manner (e.g., in serial or in parallel) and/or in a particular order, those skilled in the art will appreciate that in other embodiments the operations may be performed in other orders and in other manners. Those skilled in the art will also appreciate that the data structures discussed above may be structured in different manners, such as by having a single data structure split into multiple data structures or by having multiple data structures consolidated into a single data structure. Similarly, in some embodiments illustrated data structures may store more or less information than is described, such as when other illustrated data structures instead lack or include such information respectively, or when the amount or types of information that is stored is altered.

From the foregoing it will be appreciated that, although specific embodiments have been described herein for purposes of illustration, various modifications may be made without deviating from the spirit and scope of the invention. Accordingly, the invention is not limited except as by the appended claims and the elements recited therein. In addition, while certain aspects of the invention are presented below in certain claim forms, the inventors contemplate the various aspects of the invention in any available claim form. For example, while only some aspects of the invention may currently be recited as being embodied in a computer-readable medium, other aspects may likewise be so embodied.

What is claimed is:

1. A non-transitory computer-readable medium having stored contents that configure a computing device to perform a method, the method comprising:

receiving an indication of aggregate demand among a plurality of users of an item transaction system to purchase an indicated item that has multiple copies;

in response to the received indication of the aggregate demand, identifying multiple users of the plurality of users of the item transaction system who each has an available copy of the indicated item to sell and who is not currently allowed to sell items to the plurality of users of the item transaction system;

determining other items that are available to be sold by at least one of the identified users and that are distinct from the indicated item;

for each of the identified users, determining an effect if the identified user receives an opportunity to sell items to the plurality of users of the item transaction system, the determined effect being based at least in part on a change in an aggregate amount of supply for the determined other items among the plurality of users of the item transaction system that is determined to result from the available items of the identified user being made available for sale based on the received opportunity; and determining one or more of the identified users based at least in part on the determined effects for the determined one or more users and based at least in part on the indicated aggregate demand; and notifying each of the determined users of an opportunity to sell at least one available item to another of the plurality of users of the item transaction system.

2. The non-transitory computer-readable medium of claim 1 wherein the notifying of each of the determined users of the opportunity to sell at least one available item is performed without identifying which items of the determined user are included in the opportunity.

3. The non-transitory computer-readable medium of claim 1 wherein the notifying of one of the determined users of the opportunity to sell at least one available item includes indicating an expiration of the opportunity after which the one determined user is not able to sell any items to the plurality of users of the item transaction system.

4. The non-transitory computer-readable medium of claim 1 wherein the notifying of one of the determined users of the opportunity to sell at least one available item includes indicating a period of exclusivity of the opportunity during which the one determined user receives a guarantee of being able to sell one or more of the available items of the one determined user.

5. The non-transitory computer-readable medium of claim 1 wherein the determining of one of the one or more identified users includes determining a subset of available items of the one user that the one user will receive an opportunity to sell, and wherein the notifying of the one user of the opportunity includes providing one or more user-selectable controls that the one user may select to obtain information about the determined subset of available items of the one user that the one user is currently able to sell.

6. The non-transitory computer-readable medium of claim 1 wherein the method further comprises, prior to the receiving of the indication of the aggregate demand, providing a group of multiple users of the item transaction system with an opportunity to sell available items of the users of the group, the multiple users of the group each being one of the identified multiple users, and wherein the determining of the one or more users of the item transaction system to notify is further based in part on the prior providing of the opportunity to the multiple users of the group.

7. The non-transitory computer-readable medium of claim 1 wherein the determining of the effect for an identified user is further based at least in part on an amount of aggregate demand from the plurality of users of the item transaction system for the determined other items that are available from that identified user.

8. The non-transitory computer-readable medium of claim 1 wherein the determining of the effect for an identified user includes, for each of the determined other items that are available from that identified user:

determining an actual number of users of the item transaction system who have the determined other item available and who have been notified of a currently available opportunity to sell available items;

determining a desired target number of users with the determined other item available to notify of a currently available opportunity to sell available items, the desired target number of users being based on a current amount of aggregate demand for the determined other item;

if the determined actual number of users is less than the determined desired target number of users, and if the identified user has the determined other item available to sell, determining that the effect of the identified user receiving the opportunity is a positive effect; and if the determined actual number of users is more than the determined desired target number of users, and if the identified user has the determined other item available to sell, determining that the effect of the identified user receiving the opportunity is a negative effect, and wherein the determining of the one or more identified users includes selecting a quantity of identified users that is based at least in part on a difference between the determined actual number of users and the determined desired target number of users.

9. A non-transitory computer-readable medium having stored contents including instructions that, when executed, configure a computing device to perform a method, the method comprising:

receiving an indication of aggregate demand among a plurality of users of an item transaction system to purchase a first item that has multiple copies;

determining, by the configured computing device and in response to the indication of the aggregate demand, one or more users of the plurality of users to receive an opportunity to sell available items via the item transaction system, the determining being based at least in part on an aggregate amount of supply among the plurality of users for a second item distinct from the first item and including identifying, for each of multiple users who have available copies of the first item to sell, a change in the aggregate amount of supply for the second item if the identified user receives the opportunity to sell available items via the item transaction system;

notifying each of the determined one or more users of the opportunity to sell items via the item transaction system;

for a third item that has a determined amount of aggregate supply among the plurality of users of the item transaction system, determining at least one user of the item transaction system that desires the third item to receive a current opportunity to purchase available items via the item transaction system, the determining of the at least one user being based at least in part on an amount of aggregate demand among the plurality of users for a fourth item distinct from the third item; and notifying the determined at least one users of the current opportunity, and preventing other of the plurality of users of the item transaction system that are distinct from the determined at least one users from having a current opportunity to purchase available items via the item transaction system based at least in part on the aggregate demand for the fourth item.

10. A configured computing system comprising:

one or more processors; and an item supply availability manager component that is configured to, when executed by at least one of the one or more processors, initiate item transactions by:

receiving an indication of aggregate demand among a plurality of users to purchase an indicated item that has multiple copies;

in response to the received indication of the aggregate demand, identifying one of the plurality of users who is not currently allowed to sell items to the plurality of users, the identified one user having a plurality of available items that include an available copy of the indicated item and include one or more other items distinct from the indicated item;

determining an effect on aggregate supply of the one or more other items among the plurality of users if the identified user receives an opportunity to offer the plurality of available items for sale to the plurality of users; and selecting the identified one user to receive the opportunity based at least in part on the determined effect; and notifying the identified one user of the opportunity.

11. The computing system of claim 10 wherein the notifying of the identified one user of the opportunity is performed without identifying which of the plurality of items are included in the opportunity.

12. The computing system of claim 10 wherein the notifying of the identified one user of the opportunity includes indicating an expiration of the opportunity after which the identified one user is not allowed to sell items to the plurality of users.

13. The computing system of claim 10 wherein the item supply availability manager component includes software instructions that, when executed, further configure the configured computing system to, prior to the receiving of the indication of the aggregate demand, provide a group of multiple of the plurality of users with an opportunity to sell available items to the plurality of users, and wherein the selecting of the identified one user is further based in part on the identified one user not being one of the multiple users of the group.

14. The computing system of claim 10 wherein the item supply availability manager component includes software instructions that, when executed, further configure the configured computing system to identify multiple additional users who each has an available copy of the indicated item to sell, and wherein the determining of the effect includes, for each of the one or more other items:

determining an actual number of the plurality of users who have the other item available and who have been notified of a currently available opportunity to sell available items;

determining a desired target number of users with the other item available to notify of a currently available opportunity to sell available items, the desired target number of users being based on a current amount of demand for the other item;

if the determined actual number of users is less than the determined desired target number of users, determining that the effect of the identified user receiving the opportunity is a positive effect; and if the determined actual number of users is more than the determined desired target number of users, determining that the effect of the identified user receiving the opportunity is a negative effect, and wherein the selecting of the identified one user includes selecting a subset of the multiple additional identified users that has a quantity of users based at least in part on a difference between the determined actual number of users and the determined desired target number of users, and notifying each of the multiple additional identified users of the selected subset of an opportunity to sell at least one item to the plurality of users.

15. The computing system of claim 10 wherein the item supply availability manager component is part of an item transaction system, wherein the plurality of users are users of the item transaction system, and wherein the item supply availability manager component is further configured to, for a second item that is distinct from the indicated item and that has a determined amount of aggregate supply among the plurality of users of the item transaction system, determine at least one user of the item transaction system that desires the second item and notify the determined at least one users of a current opportunity to purchase available items via the item transaction system, and wherein other of the plurality of users of the item transaction system that are distinct from the determined at least one users do not have a current opportunity to purchase available items via the item transaction system.

16. The computing system of claim 10 wherein the item supply availability manager component consists of one or more means for performing the initiating of the item transactions.

17. A computer-implemented method comprising:

receiving an indication of aggregate demand among a plurality of users of an item transaction system to purchase an indicated item that has multiple copies;

in response to the received indication of the aggregate demand:

identifying, by a configured computing device, multiple users of the plurality of users who each has an available copy of the indicated item to sell, the multiple users further having one or more available second items distinct from the indicated item to sell;

for each of the identified multiple users, determining, by the configured computing device, an effect on aggregate supply of the one or more available second items among the plurality of users if the identified user receives an opportunity to sell available items to the plurality of users; and selecting, by the configured computing device, one or more users of the identified multiple users to receive the opportunity based at least in part on the determined effects for the selected one or more users, wherein the selecting is performed to minimize an excess in the aggregate supply of the one or more available second items relative to aggregate demand for the one or more available second items or to increase an insufficiency in the aggregate supply of the one or more available second items relative to the aggregate demand for the one or more available second items; and notifying the selected one or more users of the opportunity.

18. The method of claim 17 wherein the notifying of the selected one or more users of the opportunity is performed without identifying which available items are included in the opportunity.

19. The method of claim 17 wherein the selected one or more users are not allowed to sell items to the plurality of users at a time of the identifying of the multiple users, and wherein the notifying of the selected one or more users of the opportunity includes indicating an expiration of the opportunity after which the selected one or more users are again not allowed to sell items to the plurality of users.

20. The method of claim 17 wherein the notifying of the selected one or more users of the opportunity includes indicating a period of exclusivity of the opportunity during which the selected one or more users receive a guarantee of being able to sell at least one of the one or more available second items.

21. The method of claim 17 wherein the selecting of one of the one or more users includes determining a subset of available items of the one user that the one user will be allowed to sell, and wherein the notifying of the selected one or more users of the opportunity includes providing to the one user one or more user-selectable controls that the one user may use to obtain information about the determined subset of available items of the one user.

22. The method of claim 17 further comprising, prior to the receiving of the indication of the aggregate demand, providing a group of multiple users of the item transaction system with an opportunity to sell available items, and wherein the selecting of the one or more users is further based in part on the prior providing of the opportunity to the multiple users of the group.

23. The method of claim 17 wherein the determining of the effect for one of the identified multiple users is further based at least in part on an amount of aggregate demand from the plurality of users of the item transaction system for the one or more available second items and on which of the one or more available second items are available from the one identified user.

24. The method of claim 17 wherein one of the identified multiple users has a first item available that is one of the one or more available second items, and wherein the determining of the effect for the one identified user include:

determining an actual number of users of the item transaction system who have the first item available and who have been notified of a currently available opportunity to sell available items;

determining a desired target number of users with the first item available to be notified of a currently available opportunity to sell available items, the desired target number of users being based on a current amount of aggregate demand for the first item;

if the determined actual number of users is less than the determined desired target number of users, determining that the effect of the one identified user receiving the opportunity is a positive effect; and if the determined actual number of users is more than the determined desired target number of users, determining that the effect of the one identified user receiving the opportunity is a negative effect, and wherein the selecting of the one or more users includes selecting a quantity of identified users that is based at least in part on a difference between the determined actual number of users and the determined desired target number of users.

25. The method of claim 17 further comprising, a first item that is acquirable via the item transaction system and that has a determined amount of aggregate supply among the plurality of users of the item transaction system, determining at least one user of the item transaction system that desires the first item and notifying the determined at least one users of a current opportunity to purchase available items via the item transaction system, and wherein other of the plurality of users of the item transaction system that are distinct from the determined at least one user do not have a current opportunity to purchase available items via the item transaction system.

26. The computing system of claim 10 wherein the selecting of the identified one user is performed in order to decrease an excess aggregate supply of the one or more other items relative to aggregate demand for the one or more other items or to increase an insufficient aggregate supply of the one or more other items relative to the aggregate demand for the one or more other items.

27. The computing system of claim 10 wherein the received indication of the aggregate demand is based on an automated determination that aggregate supply of the indicated item among the plurality of users is not sufficient to satisfy the aggregate demand for the indicated item.

28. The non-transitory computer-readable medium of claim 1 wherein the determining of the one or more identified users is performed to decrease an excess in the aggregate amount of supply of the determined other items relative to aggregate demand for the determined other items or to increase an insufficiency in the aggregate amount of supply of the determined other items relative to the aggregate demand for the determined other items.

* * * * *

UNITED STATES PATENT AND TRADEMARK OFFICE

CERTIFICATE OF CORRECTION

PATENT NO. : 8,719,109 B1
APPLICATION NO. : 11/693501
DATED : May 6, 2014
INVENTOR(S) : Mehmet A. Elicin et al.

It is certified that error appears in the above-identified patent and that said Letters Patent is hereby corrected as shown below:

In the Claims

Column 24, Line 52, Claim 24:
"of the effect for the one identified user include:" should read, --of the effect for the one identified user includes:--.

Column 25, Line 8, Claim 25:
"25. The method of claim 17 further comprising, a first item" should read, --25. The method of claim 17 further comprising, for a first item--.

Column 25, Line 13, Claim 25:
"item and notifying the determined at least one users of a" should read, --item and notifying the determined at least one user of a--.

Signed and Sealed this
Eleventh Day of November, 2014

Michelle K. Lee

Michelle K. Lee
*Deputy Director of the United States Patent and Trademark Office*